US009539831B2

(12) United States Patent
Tanami et al.

(10) Patent No.: US 9,539,831 B2
(45) Date of Patent: Jan. 10, 2017

(54) PRINTING APPARATUS, CONVEYANCE APPARATUS, AND CONVEYANCE CONTROL METHOD

(75) Inventors: Haruhiko Tanami, Fuchu (JP); Yuki Igarashi, Tokyo (JP); Ryoya Shinjo, Kawasaki (JP); Ryohei Maruyama, Kawasaki (JP); Shin Genta, Yokohama (JP); Naoki Wakayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 937 days.

(21) Appl. No.: 13/429,727

(22) Filed: Mar. 26, 2012

(65) Prior Publication Data

US 2012/0263514 A1 Oct. 18, 2012

(30) Foreign Application Priority Data

Apr. 15, 2011 (JP) ..... 2011-091469
Jul. 21, 2011 (JP) ..... 2011-160301
Feb. 27, 2012 (JP) ..... 2012-040668

(51) Int. Cl.
*B65H 23/18* (2006.01)
*B41J 15/04* (2006.01)
*B41J 11/42* (2006.01)

(52) U.S. Cl.
CPC ..... *B41J 15/04* (2013.01); *B41J 11/42* (2013.01)

(58) Field of Classification Search
CPC ..... B65H 23/06; B65H 23/08; B65H 23/18; B65H 23/182; B65H 23/185; B65H 59/02; B65H 59/10; B65H 77/00; B41J 11/42; B41J 15/04
USPC ... 242/412, 412.1, 412.2, 412.3, 413, 413.3, 242/413.7, 418, 418.1, 419, 419.1, 420, 242/420.6
See application file for complete search history.

(56) References Cited

U.S. PATENT DOCUMENTS 6,340,254 B1 * 1/2002 Ono ..... 400/120.16
6,880,991 B2 * 4/2005 Tsuruta et al. ..... 400/120.01
7,686,301 B2 3/2010 Kakishima
7,762,733 B2 7/2010 Kakishima et al.
8,147,023 B2 * 4/2012 Hatada et al. ..... 347/16
8,328,318 B2 12/2012 Igarashi et al.
8,801,137 B2 * 8/2014 Yoshida et al. ..... 347/16
(Continued)

FOREIGN PATENT DOCUMENTS

CN 1350928 A 5/2002
CN 101100139 A 1/2008
(Continued)

OTHER PUBLICATIONS

Chinese Office Action issued in Chinese Application No. 201210111381.1 dated Jun. 5, 2014.

*Primary Examiner* — William A Rivera
(74) *Attorney, Agent, or Firm* — Fitzpatrick, Cella, Harper & Scinto

(57) ABSTRACT

This invention has been made to cause a printing apparatus for conveying roll paper and performing printing to simultaneously attain a stable conveyance accuracy and prevent skewed conveyance independently of LF roller driving conditions and disturbance conditions that variously change as the roll paper state changes. For this purpose, a feed motor is used as a load generator for the roll paper. A section from a conveyance operation by the LF roller to the next conveyance operation is divided into a plurality of sub-sections. A feed mechanism is controlled by switching between a feeder load generation section and a feeder load zero section for each sub-section.

14 Claims, 17 Drawing Sheets

(56) References Cited

U.S. PATENT DOCUMENTS

| | | | | |
|---|---|---|---|---|
| 8,899,853 | B2 * | 12/2014 | Kikuchi et al. | 400/611 |
| 8,931,878 | B2 * | 1/2015 | Sano | 347/19 |
| 2007/0059080 | A1 * | 3/2007 | Silverbrook et al. | 400/614 |
| 2008/0011805 | A1 * | 1/2008 | Genta | B65H 19/126 226/51 |
| 2009/0245912 | A1 * | 10/2009 | Igarashi et al. | 400/618 |
| 2010/0053251 | A1 * | 3/2010 | Igarashi et al. | 347/16 |
| 2012/0012634 | A1 * | 1/2012 | Hatada et al. | 226/8 |

FOREIGN PATENT DOCUMENTS

| | | | |
|---|---|---|---|
| CN | 101100140 | A | 1/2008 |
| CN | 101659161 | A | 3/2010 |
| JP | 9-164737 | A | 6/1997 |
| JP | 2007-203564 | A | 8/2007 |
| JP | 2009119792 | A | 6/2009 |
| JP | 2009-263044 | A | 11/2009 |
| JP | 2010-052379 | A | 3/2010 |

* cited by examiner

CONTROL SECTION α
CONTROL SECTION β
CONTROL SECTION γ
VELOCITY
DOTTED LINE: Vlf
SOLID LINE: Vroll
(time)
t
0
B
C
D
E
F
G Troll
Tset +Trefload +Tac
Tset +Trefload +Tdc
Tset +Trefload
ccw
cw
Tset +Trefload +Tdc
Tidle - Trefload Tpap

SLACK AMOUNT
SLACK SIDE
TENSION SIDE
SECOND SECTION
FIRST SECTION
THIRD SECTION

ACCELERATION REGION
STEADY REGION
DECELERATION REGION
Vlf
0
A
B
C
D
t (time)
Tlf
ccw
cw
Ts
Ts+Ta
Ts+Td Vroll
WOUND BACK BY SET VALUE d BECAUSE OF PRESENCE OF SLACK
t1
E
SLACK
Troll
T1
T2
T3
SET VALUE b
SET VALUE a
SET VALUE d
SET VALUE c Tpap
LOAD FORCE La
LOAD FORCE Ld
LOAD FORCE La

PRINTING APPARATUS, CONVEYANCE APPARATUS, AND CONVEYANCE CONTROL METHOD

BACKGROUND OF THE INVENTION

Field of the Invention

The present invention relates to a printing apparatus, a conveyance apparatus, and a conveyance control method. Particularly, the present invention relates to a printing apparatus that stabilizes a back tension variation during, for example, roll paper conveyance by a conveyance roller, a conveyance apparatus, and a roll paper conveyance control method in the apparatus.

Description of the Related Art

There are printing apparatuses that use large paper having a size of A2 or more. A printing apparatus of this type often uses roll paper (a rolled portion where a sheet is wound will be referred to as roll paper, and a portion pulled out from the roll paper will be referred to as a sheet portion hereinafter) in addition to sheets. The sheet portion is pulled out from the roll paper by rotating a conveyance roller. However, since the roll paper is heavy in weight, a large force is necessary for pulling out the sheet portion. When only the driving force of a conveyance motor for driving the conveyance roller is used, the end portion of the roll paper is pulled, but the roll paper itself does not rotate because of its weight. Hence, the sheet may be torn. An apparatus has been developed, which includes a roll paper motor independently of the conveyance motor. The roll paper motor is driven together with the conveyance motor, thereby pulling out the sheet portion.

As a printing apparatus of this type, an apparatus disclosed in Japanese Patent Laid-Open No. 2009-263044 is known. This printing apparatus is of a type that intermittently conveys roll paper, and includes a conveyance roller, a roll paper motor, a conveyance motor, a tension measurement unit that measures a tension generated in the roll paper, and a motor control unit that controls driving of at least one of the roll paper motor and the conveyance motor based on the tension measurement result. In this arrangement, the motors are feedback-controlled based on the tension accurately measured by the tension measurement unit so as to decide the conveyance amount of the roll paper. This makes it possible to appropriately control the tension acting on the roll paper and prevent variation in the tension caused by a change in the diameter of the roll paper.

As an arrangement different from that described above, a printing apparatus disclosed in Japanese Patent Laid-Open No. 2007-203564 is also known. This printing apparatus includes a conveyance roller, a conveyance motor, a wind-off roller arranged at a position contactable with the outer surface of roll paper, a wind-off motor that rotates the wind-off roller, and a control unit that rotates the wind-off roller using the printing time and the conveyance time. In this arrangement, the roll paper is rotated in the conveyance direction by an amount corresponding to the conveyance amount necessary for the conveyance operation of the conveyance roller during the time from the end of the conveyance operation of the conveyance roller to the start of the next conveyance operation. This allows the roll paper to always have a slack so that the conveyance accuracy can be improved without any influence of the inertia of the roll paper.

There is known a conveyance apparatus that pulls out a sheet (to be referred to as a rolled portion hereinafter) wound into a roll and sandwiches the pulled out sheet between a conveyance roller and its associated roller, thereby conveying the sheet. A load is given to the axis portion of the rolled portion using a torque limiter or the like. The load is applied to the sheet portion as a back tension in a direction reverse to the conveyance direction so that an appropriate tension can be generated in the sheet between the rolled portion and the conveyance roller.

For example, Japanese Patent Laid-Open No. 9-164737 discloses an image printing apparatus including a conveyance apparatus provided with a remaining sheet detection unit that detects the remaining amount of a sheet wound into roll paper, and a back tension application unit capable of changing the torque of a load engaging with the axis of the roll paper.

In Japanese Patent Laid-Open No. 2009-263044, however, since the sheet portion is always given a tension, the sheet may slip on the conveyance roller due to the tension, and the actual conveyance amount may be smaller than that instructed by the control unit. This may affect the conveyance accuracy not a little.

To the contrary, according to an arrangement disclosed in Japanese Patent Laid-Open No. 2007-203564, the conveyance amount never becomes smaller because no tension is applied to the roll paper at all. On the other hand, skewed conveyance of the sheet portion may occur due to inappropriate setting by the user, a slightly nonuniform roller conveyance force in the direction of the roll paper width, or a slightly shifted parallelism between the roll center axis and the roller shaft.

To prevent the skewed conveyance, a method of applying a load by controlling the roll paper motor or using, for example, a torque limiter engaging with the axis of the roll paper is employed. When the load is applied to the roll paper as a back tension in a direction reverse to the conveyance direction, skewed conveyance of the roll paper is corrected by the back tension and the conveyance force so that wrinkles can be prevented.

However, in the arrangement of Japanese Patent Laid-Open No. 2007-203564, the back tension cannot be applied because of the absence of the load on the roll paper. Hence, it is difficult to correct skewed conveyance of the sheet portion.

In a printing apparatus for printing an image by serially scanning a carriage including a printhead, sheet conveyance and printing by carriage scan are alternately repeated, thereby printing an image on the entire sheet. In this case, the sheet conveyance amount at a time is equal to or smaller than the print length of the printhead. Let us examine one operation from the start to end of conveyance. There are the acceleration section, the steady section, and the deceleration section of the sheet, or only the acceleration section and the deceleration section. That is, the ratio of the acceleration and deceleration sections during the conveyance is high. In addition, to implement fast printing demanded of recent printing apparatuses, a higher conveyance velocity and a more abrupt acceleration/deceleration operation are required in some cases. Hence, the difference between the steady load set value and the load set value necessary at the time of acceleration/deceleration is supposed to be larger.

Under these circumstances, in the arrangement disclosed in Japanese Patent Laid-Open No. 9-164737 where the back tension variation caused by acceleration/deceleration of sheet conveyance is not taken into consideration, the sheet may slack because only the steady load torque corresponding to the remaining amount of the sheet is set. As a result, tension and slack repetitively occur in every conveyance operation. This may deteriorate the conveyance accuracy, resulting in poorer image quality.

SUMMARY OF THE INVENTION

Accordingly, the present invention is conceived as a response to the above-described disadvantages of the conventional art.

For example, a printing apparatus, conveyance apparatus, and conveyance control method according to this invention are capable of, in a case of using roll paper as a printing medium, accurately conveying a sheet while accurately pulling out the sheet from the roll paper, or conveying the sheet always at a stable accuracy independently of the condition of the acceleration applied to the sheet.

According to one aspect of the present invention, there is provided a printing apparatus for feeding roll paper formed by winding a sheet into a roll and conveying the fed roll paper, thereby performing printing, comprising: a feed motor configured to rotate the roll paper for feed from the roll paper; a conveyance roller configured to sandwich an edge portion of the fed roll paper and convey the roll paper; a conveyance motor configured to rotate the conveyance roller; and a control unit configured to divide a conveyance operation, comprised of: by driving the feed motor and the conveyance motor, accelerating the roll paper from a stopped state to a steady state; decelerating the roll paper; and stopping the roll paper, into a plurality of sections and control to change a torque applied by the conveyance motor to the conveyance roller and a torque applied by the feed motor to the roll paper in each of the divided sections.

According to another aspect of the present invention, there is provided a roll paper conveyance control method applied to a printing apparatus that includes roll paper formed by winding a sheet into a roll, a feed motor configured to rotate the roll paper for feed from the roll paper, a conveyance roller configured to sandwich an edge portion of the fed roll paper and convey the roll paper, and a conveyance motor configured to rotate the conveyance roller, and conveys the fed roll paper, thereby performing printing, comprising: dividing a conveyance operation, comprised of: by driving the feed motor and the conveyance motor, accelerating the roll paper from a stopped state to a steady state; decelerating the roll paper; and stopping the roll paper, into a plurality of sections; and controlling to change a torque applied by the conveyance motor to the conveyance roller and a torque applied by the feed motor to the roll paper in each of the divided sections.

According to still another aspect of the present invention, there is provided a conveyance apparatus for pulling out, in a conveyance direction, a sheet wound into a roll around a roll shaft and conveying the pulled out sheet by a conveyance roller, comprising: a conveyance motor configured to rotate the conveyance roller; a first control unit configured to control the conveyance motor such that a rotation velocity of the conveyance roller in the conveyance direction increases in an acceleration region of the conveyance roller, becomes constant in a steady region, and decreases in a deceleration region; a feed motor configured to rotate, about the roll shaft, a rolled portion that is a portion of the sheet wound into the roll; and a second control unit configured to control driving of the feed motor so as to apply a back tension to the sheet between the rolled portion and the conveyance roller, wherein the second control unit is further configured to, when the conveyance roller conveys the sheet in at least one of the acceleration region and the deceleration region, control the feed motor so as to rotate the rolled portion by a torque different from that when the conveyance roller conveys the sheet in the steady region.

According to still another aspect of the present invention, there is provided a printing apparatus comprising: the above-described conveyance apparatus; and a printing unit configured to print on a sheet conveyed by the conveyance apparatus.

According to still another aspect of the present invention, there is provided a conveyance control method upon pulling out, in a conveyance direction, a sheet wound into a roll around a roll shaft and conveying the pulled out sheet with a back tension applied by a conveyance roller, comprising: controlling the conveyance roller such that a rotation velocity of the conveyance roller in the conveyance direction increases in an acceleration region of the conveyance roller, becomes constant in a steady region, and decreases in a deceleration region; and when the conveyance roller conveys the sheet in at least one of the acceleration region and the deceleration region, controlling to rotate the sheet wound into the roll by a torque different from that when the conveyance roller conveys the sheet in the steady region.

The invention is particularly advantageous since the torque to be applied from the feed motor to the roll paper is finely controlled, more accurate roll paper conveyance can be implemented, and skewed conveyance can be prevented.

In addition, since control is performed to apply a back tension suitable to each sheet conveyance state including an acceleration section, a steady section, and a deceleration section, a stable conveyance accuracy can always be attained.

Further features of the present invention will become apparent from the following description of exemplary embodiments (with reference to the attached drawings).

DESCRIPTION OF THE EMBODIMENT

Figure 1:
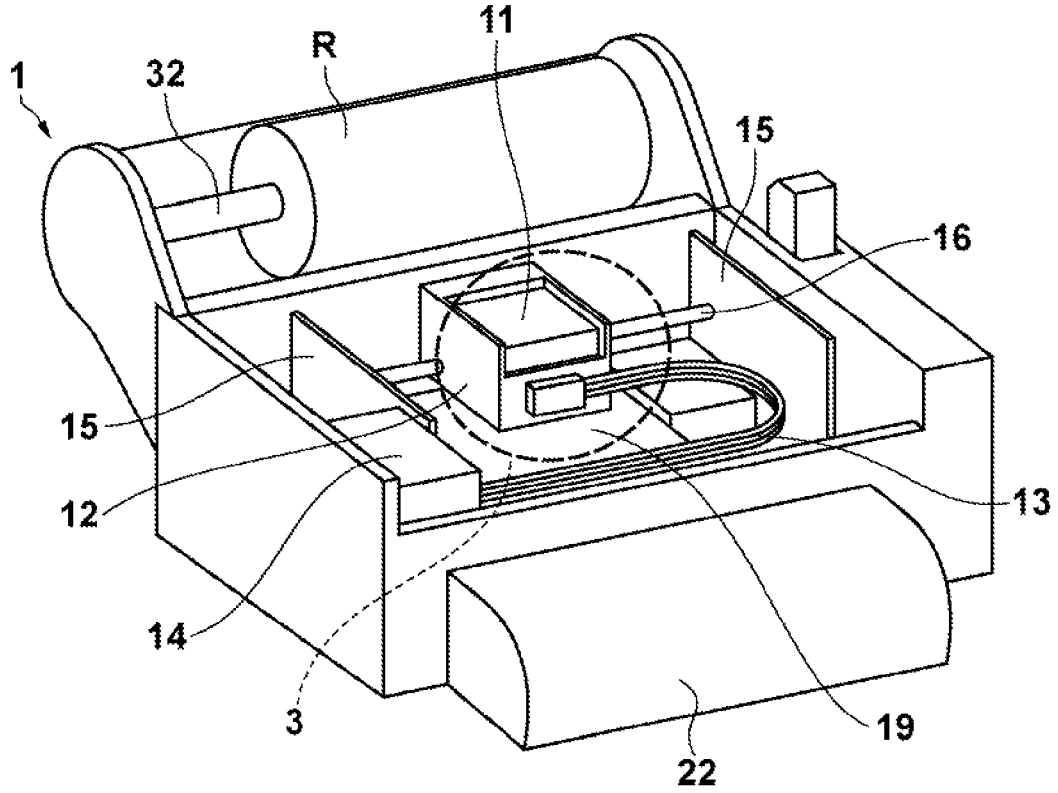
FIG. 1 is a perspective view showing the schematic arrangement of an inkjet printing apparatus according to a representative embodiment of the present invention.

Exemplary embodiments of the present invention will now be described in detail in accordance with the accompanying drawings. Note that the same reference numerals denote already described parts, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

In the following explanation, roll paper is used as a sheet. However, for example, fabric, leather, a plastic film, a metal plate, or the like wound into a roll can also be used.

Figure 2:
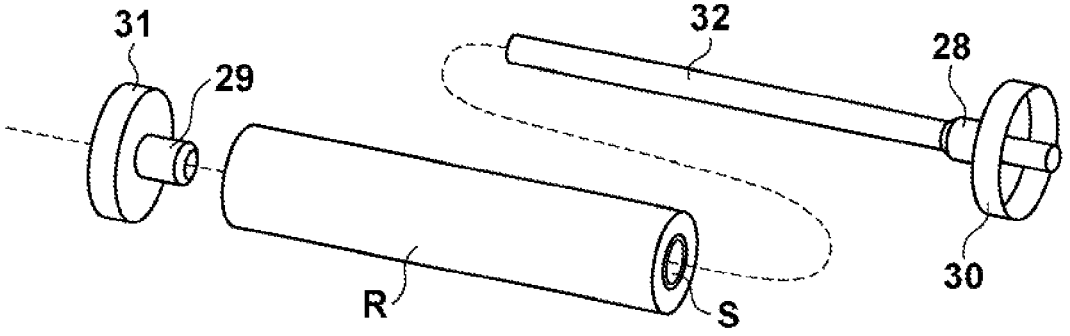
FIG. 2 is a perspective view showing the arrangement of the spool portion of roll paper shown in FIG. 1.
Figure 3:
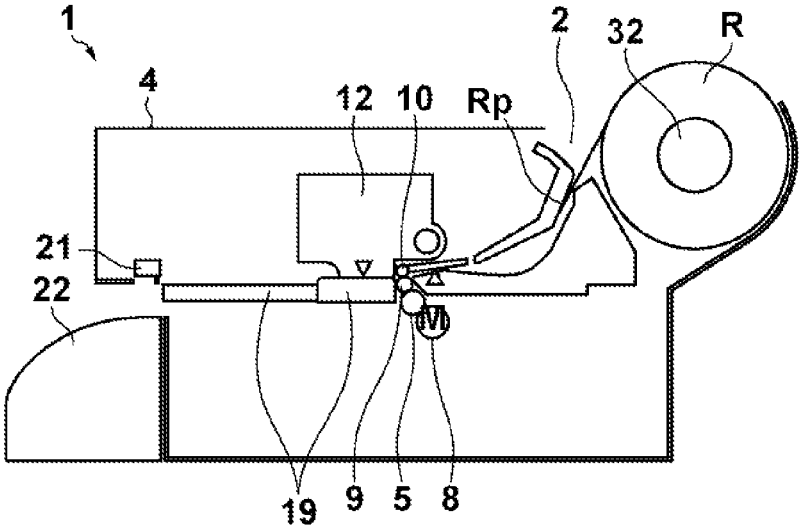
FIG. 3 is a side sectional view showing the schematic arrangement of the printing apparatus including the feed mechanism of roll paper shown in FIG. 1.

FIG. 1 is a perspective view showing the schematic arrangement of an inkjet printing apparatus (to be referred to as a printing apparatus hereinafter) including the feed mechanism of roll paper according to an exemplary embodiment of the present invention. FIG. 2 is a perspective view showing the arrangement of the spool portion of roll paper shown in FIG. 1. FIG. 3 is a sectional view showing the schematic arrangement of the printing apparatus including the feed mechanism of the roll paper shown in FIG. 1.

An operation of setting roll paper serving as a printing medium will be described first.

In this embodiment, roll paper R that is continuous paper wound into a roll is used as a printing medium. As shown in the perspective view of FIG. 2, a spool shaft 32 passes through a paper tube S at the winding center of the roll paper R. A loading portion 28 of a reference-side roll paper holder 30 arranged on the spool shaft 32 fits to the inner wall of the paper tube S due to the elastic force in the radial direction so as to be fixed and held. Note that the reference-side roll paper holder 30 is fixed not to rotate with respect to the spool shaft 32.

In addition, a non-reference-side roll paper holder 31 is fitted on the spool shaft 32 from the side opposite to the reference-side roll paper holder 30 and set in the paper tube S so as to sandwich the roll paper R. Note that the non-reference-side roll paper holder 31 also has a loading portion 29 which is fixed and held in the paper tube S by the elastic force in the radial direction. As shown in FIG. 1, a main body portion 1 of the printing apparatus rotatably supports the two ends of the spool shaft 32, thereby rotatably holding the roll paper R. The leading edge of the roll paper R is represented by Rp in the following explanation.

A feed operation will be described next.

The user guides the leading edge $R_p$ of the roll paper R set at the position shown in FIG. 3 to a conveyance port 2. When the user rotates the roll paper R in the counterclockwise (CCW) direction, the leading edge $R_p$ of the roll paper R is fed to the downstream side through the conveyance path. A reflection type sheet detection sensor is provided midway along the conveyance path. Upon detecting the passage of the leading edge $R_p$ of the roll paper R, a conveyance motor (LF motor) 8 causes a conveyance roller (LF roller) 9 to start rotating in the CCW direction that is the sheet conveyance direction.

The leading edge $R_p$ of the roll paper R further sent to the downstream side by the user reaches the nip portion of a pair of LF rollers 9 and 10. The sheet is conveyed onto a platen 19 while being sandwiched by the pair of LF rollers 9 and 10. At this time, an edge detection sensor mounted on a carriage 12 detects the passage of the sheet to confirm that the sheet has surely reached the platen. Note that since the pair of LF rollers 9 and 10 automatically conveys the sheet in the subsequent operation, the user releases the roll paper at this point of time.

Image formation on the roll paper R conveyed to the platen 19 will be described next.

The main body portion 1 of the printing apparatus includes an image printing unit surrounded by a broken line 3 in FIG. 1. The image printing unit 3 includes an inkjet printhead (to be referred to as a printhead hereinafter) 11, the carriage 12 to which the printhead 11 is mounted, and the platen 19 provided so as to face the printhead 11.

The printhead 11 includes, on the surface facing the print surface, a plurality of nozzle arrays (not shown) in the roll paper conveyance direction. The nozzle arrays discharge inks of different colors, respectively. Note that each color ink is supplied from an ink tank 14 to the nozzle of the corresponding color of the printhead 11 through an ink supply tube 13. The carriage 12 is supported slidably along a guide shaft 16 and a guide rail (not shown) which are arranged to be parallel to each other and have the end portions fixed to a frame 15 of the main body portion 1.

The inks are discharged from the printhead 11 to the roll paper conveyed to the image printing unit 3 while reciprocally moving the carriage 12, thereby printing an image on the roll paper. When the image is printed upon scanning one line by forward scan or backward scan of the carriage 12, the pair of LF rollers 9 and 10 conveys the roll paper by a predetermined pitch in the conveyance direction. The carriage 12 is then moved again to print the image of the next line. Upon this printing, the signal from a linear encoder (not shown) for detecting the carriage position is always monitored to keep the moving velocity of the carriage 12 constant. If the signal from the linear encoder exhibits some change due to some load variation during movement of the carriage 12, the current to be supplied to the carriage is increased or decreased to keep the velocity constant. The image of one page is printed on the roll paper by repeating the intermittent conveyance of the roll paper. The printed portion is conveyed to a discharge tray 22. When the image printing ends, the roll paper is conveyed by the pair of LF rollers 9 and 10 to a predetermined cutting position and cut by a cutter 21.

The series of processes from roll paper setting to discharge has been described above.

Figure 4:
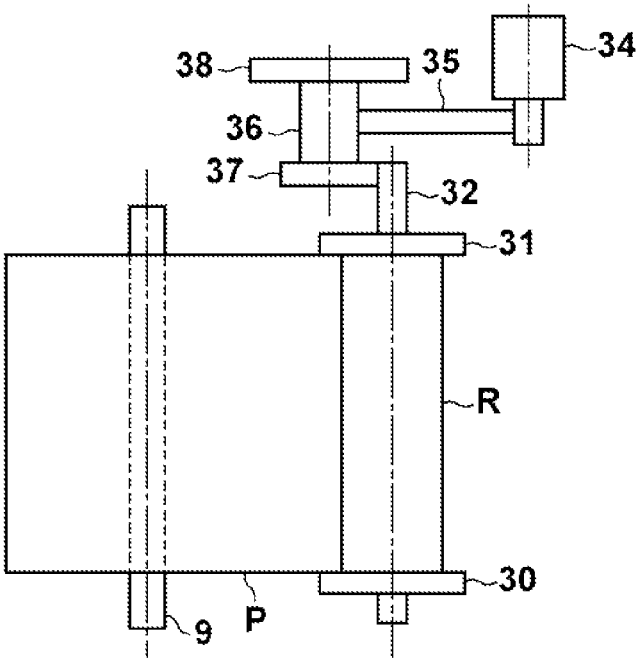
FIG. 4 is a plan view schematically showing the arrangement of a roll paper conveyance mechanism.

FIG. 4 is a plan view schematically showing the arrangement of a roll paper conveyance mechanism. The roll paper conveyance mechanism includes a feed motor 34 that applies a driving force to the roll paper R, series of gears 35 to 37 which transmit the driving force from the feed motor 34 to the spool shaft 32, and a feed encoder 38. In this arrangement, as the spool shaft 32 rotates, the roll paper R also rotates so that the sheet (a pulled out portion P of the roll paper) is fed to the pair of LF rollers 9 and 10. Additionally, a back tension is applied to the pulled out portion P between the roll paper R and the pair of LF rollers 9 and 10.

Figure 5:
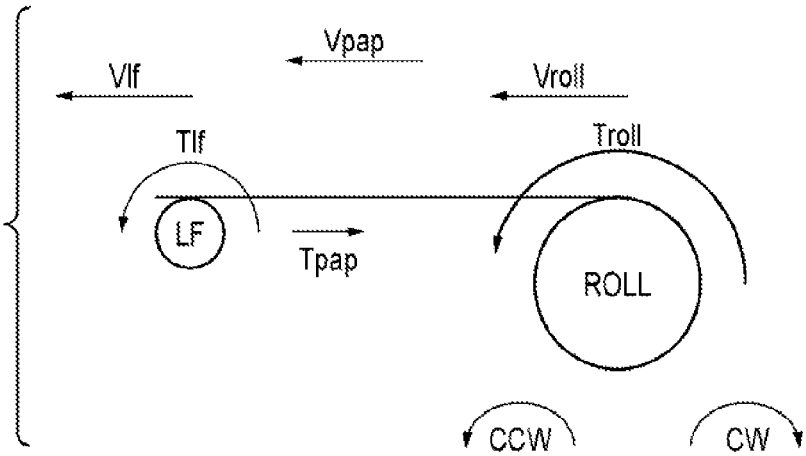
FIG. 5 is a view showing the relationship between the torques generated by the roll paper and the LF roller of the roll paper conveyance mechanism and the conveyance velocities.

FIG. 5 is a view showing the relationship between torques generated by the roll paper R and the LF roller 9 of the roll paper conveyance mechanism, and the conveyance velocities. In FIG. 5, let Tlf be the driving torque of the LF roller 9, Troll be the driving torque of the roll paper R, Tpap be the torque applied to the sheet (the pulled out portion P of the roll paper) between the LF roller 9 and the roll paper R, Vlf be the conveyance velocity of the LF roller, Vroll be the conveyance velocity of the roll paper, and Vpap be the conveyance velocity of the sheet. Note that the conveyance velocity Vlf of the LF roller and the conveyance velocity Vroll of the roll paper R are velocities on the circumferences. The larger the amount of the roll paper R is, the larger the driving torque Troll of the roll paper R is. The smaller the wound amount of the roll paper is, the smaller the driving torque Troll is.

The rotation directions of the torques Tlf and Troll, which are the forces of the rotation system, are indicated by arrows CCW and CW in FIG. 5. Tpap, Vlf, Vroll, and Vpap have positive values in the directions of arrows in FIG. 5. The force relationships will be described based on the directions shown in FIG. 5 with reference to timing charts.

General Conditions of Roll Paper Conveyance

FIGS. 6A to 6D are timing charts showing the relationship when a torque limiter is used as the load generator of the roll paper feeder, and the driving torque Troll of the roll paper R generates a predetermined load force.

The conveyance velocity Vlf (FIG. 6A) of the LF roller has a waveform corresponding to an acceleration region (time 0-A), a steady region (time A-B), and a deceleration region (time B-C). That is, in the example shown in FIG. 6A, the conveyance velocity Vlf of the LF roller increases in the acceleration region, becomes constant in the steady region, and decreases in the deceleration region.

As for the waveform of the driving torque Tlf (FIG. 6B) of the LF roller, in the acceleration region, an acceleration torque Ta is added to a steady torque Ts for the operation in the steady region. In the deceleration region, a deceleration torque Td is added to the steady torque Ts. The torque Tlf basically has the CCW value to convey the roll paper.

The driving torque Troll (FIG. 6C) of the roll paper serves as a load when viewed from the driving torque Tlf. A set value a that is the set value of the torque limiter is determined in the CW direction opposite to the direction of the torque Tlf.

As for the torque Tpap (FIG. 6D) applied to the sheet (the pulled out portion P of the roll paper) between the LF roller and the roll paper, a load torque La corresponding to the set value a of the torque Troll is generated in the steady region of the conveyance velocity Vlf from the relationship between the torques Troll and Tlf.

Figure 6A:
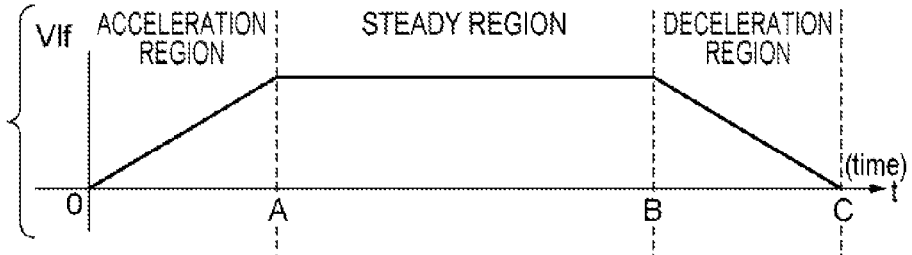
FIGS. 6A, 6B, 6C, and 6D are timing charts showing the relationship when a torque limiter is used as the load generator of the roll paper feeder, and a driving torque Troll of the roll paper generates a predetermined load force.
Figure 6B:
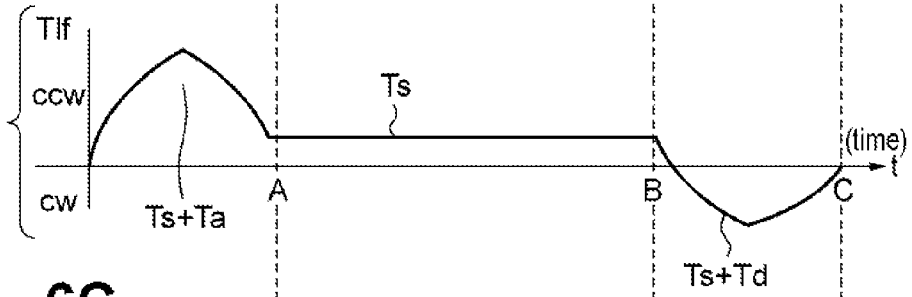
Figure 6C:
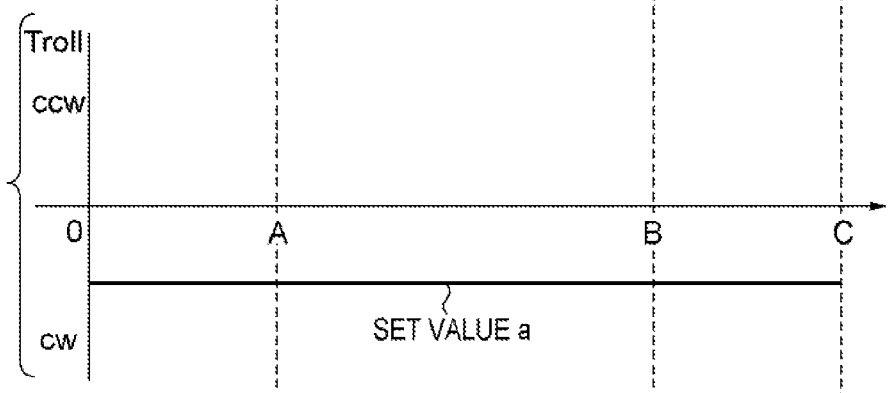
Figure 6D:
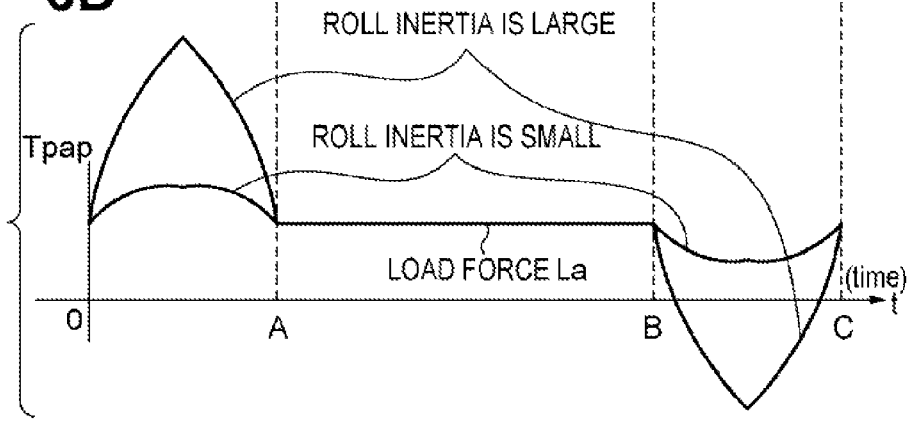

In the acceleration region of the conveyance velocity Vlf, a load corresponding to a roll paper acceleration inertia proportional to the product of the acceleration of the LF roller and the inertia of the roll paper is added to the load torque La as a roll paper acceleration inertia. When viewed from the LF roller, the roll paper acceleration inertia is a component that increases the load. Hence, the torque Tpap increases in the positive direction (CCW direction). The larger the roll inertia is, the larger the roll paper acceleration inertia component of this torque is. FIG. 6D shows two cases in which the roll inertia is large or small.

In the deceleration region of the conveyance velocity Vlf, a load corresponding to a roll paper deceleration inertia proportional to the acceleration of the LF roller (at the time of deceleration) and the inertia of the roll paper is added as a roll paper deceleration inertia. The acceleration (at the time of deceleration) exhibits a negative value. When viewed from the LF roller, the roll paper deceleration inertia is a component that decreases the load. Hence, the torque Tpap increases in the negative direction. The larger the roll inertia is, the larger the deceleration inertia is. FIG. 6D shows two cases in which the roll inertia is large or small.

When the torque Troll is constant, the load torque actually applied to the printing paper variously changes depending on the operation conditions of the LF roller and the inertia conditions of the roll paper, like the torque Tpap. This means that the paper slip amount at the time of conveyance is not constant, and image failures may occur due to the conveyance shift. In an ideal state, the torque Tpap generates a predetermined load even when the state variously changes. In addition, the smaller the torque Tpap is, the less the conveyance accuracy deteriorates.

In the above description, the roll paper deceleration inertia is added in the deceleration region. This description has been based on the assumption that no tension/slack between the LF roller and the roll paper occurs. In a case where the actual torque Troll is constant, the deceleration of the roll paper might not often follow the deceleration operation of the LF roller. In this case, paper slack occurs, and the torque Tpap gives no load. The paper slip amount, then, exhibits an amount greatly different from that in the normal state. In addition, since the no-load state continues until the slack is eliminated to restore the tension state again, the conveyance accuracy in the next conveyance may be affected.

Various embodiments to implement highly accurate roll paper conveyance will be described below.

First Embodiment

Ideal Conditions of Roll Paper Conveyance

FIGS. 7A to 7D are timing charts for explaining the set value of a torque Troll to implement an ideal state as a target as compared to FIGS. 6A to 6D. In this case, the roll paper feeder includes no torque limiter. The operation of the LF roller is the same as that described with reference to FIGS. 6A to 6D, and a description thereof will be omitted.

Idealistic drive control is to generate a load for a short period (predetermined period) from the rotation start timing of an LF roller 9 (feeder load generation section) and make the load always exhibit a value "0" during the subsequent conveyance operation (feeder load zero section). This aims at removing the skewed component of roll paper by generating the load in a short time and then conveying the paper through the subsequent section without load, thereby minimizing the deterioration of the conveyance accuracy. A torque Tpap shown in FIG. 7D reflects this state. Referring to FIG. 7D, a load force (load torque c) is instantaneously applied immediately after the start of acceleration of the LF roller 9. During LF roller driving after that, a load torque b having a value "0" is applied.

Another torque (Troll) to implement the ideal state will be described.

(1) Steady Region of LF Roller

In the steady region, the influence of the inertia component to rotate roll paper R does not exist. Hence, a torque set value b corresponding to the load torque "b" having a value "0" is set. The torque set value b equals the mechanical load that originally exists in the roll paper conveyance mechanism. For mechanical load cancellation, the set value b is set as the torque value in the CCW direction that is the same as the direction of Tlf.

(2) Acceleration Region of LF Roller

At the time of acceleration, a roll inertia acceleration torque is necessary for accelerating the roll paper R. With only the set value b that is the same as in the steady section, a load corresponding to the inertia of the roll paper R is generated (see FIG. 6B). When the torque Troll corresponding to the roll paper inertia acceleration torque is added to the set value b, the load except the set value b is expected to be suppressed.

In this acceleration region, it is necessary to switch between the feeder load generation section where the load torque to the LF roller 9 is generated and the feeder load zero section where the load torque to the LF roller 9 is "0".

To do this, the roll paper inertia acceleration torque is not generated from the driving start timing of the LF roller 9 up to a predetermined time, thereby forcibly creating a situation where the roll paper is set in the tension state. That is, a torque smaller than the roll paper inertia acceleration torque is generated up to the predetermined time. This section ranges from time 0 to time D. In this section, to apply the load torque c corresponding to the acceleration of the LF roller and the inertia of the roll paper, the torque given to the roll paper R has the torque set value b.

After that, the roll paper R (spool shaft 32) is accelerated so that the velocity of the roll paper R slightly exceeds that of the LF roller 9 from the time D to the end of acceleration of the LF roller (time A). With this control, the roll paper switches from the tension state to the slack state. After changed to the slack state, it is desirable to maintain a desired slack without generating excessive slack. To do this, after arriving at the target slack, the velocity is quickly stabilized so that the velocity of the roll paper equals that of the LF roller. Because the state of the roll paper changes to the slack state, the load torque c changes to the load torque b having a value "0".

Since the acceleration time (time D-A) of the roll paper is shorter than the acceleration time (time 0-A) of the LF roller, the roll paper inertia acceleration torque is defined by the roll paper acceleration having a value larger than that of the acceleration of the LF roller and a torque value calculated from the roll paper inertia. This force is set in the CCW direction in which the load to the LF roller becomes small, and changes the value of the torque Troll to the CCW side with respect to the set value b.

Figure 7A:
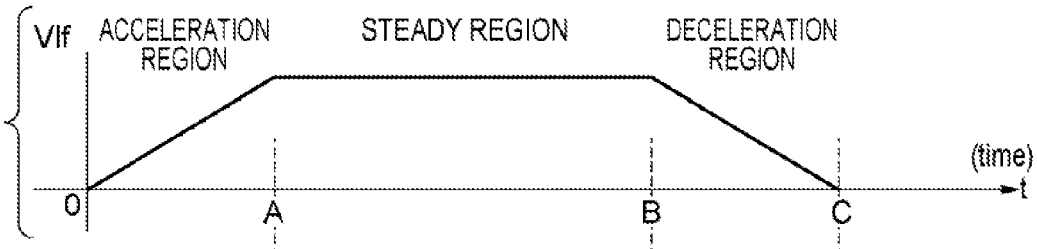
FIGS. 7A, 7B, 7C, and 7D are timing charts for explaining the set value of the torque Troll to implement an ideal state as a target.
Figure 7B:
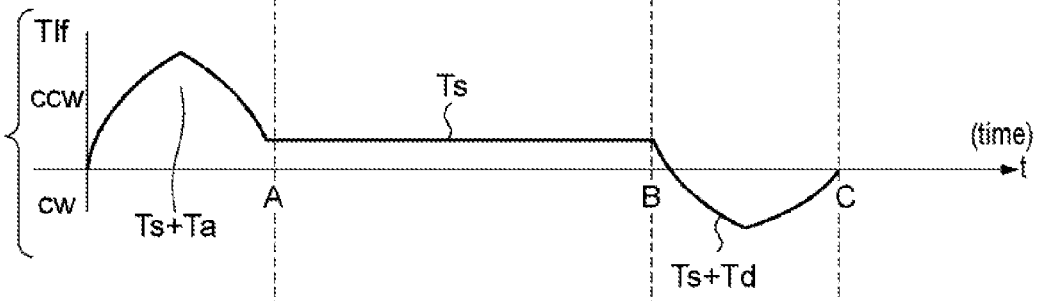
Figure 7C:
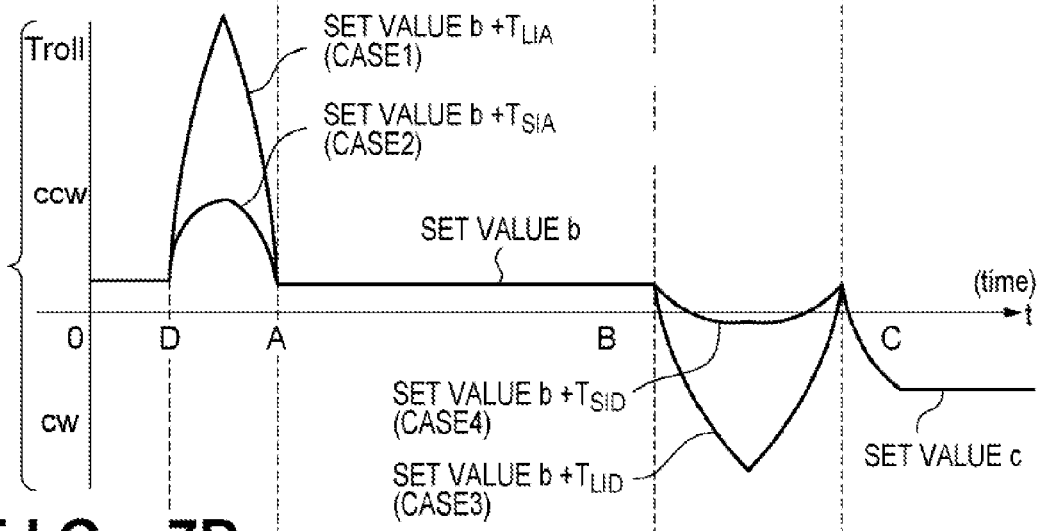
Figure 7D:
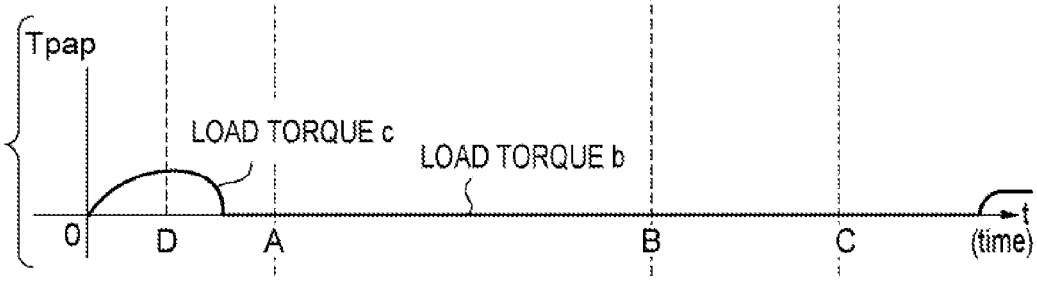

FIG. 7C shows a case (CASE 1) in which a large roll paper inertia acceleration torque $T_{LIA}$ is applied and a case (CASE 2) in which a small roll paper inertia acceleration torque $T_{SIA}$ is applied. The larger the inertia of the operation target is, the larger the roll paper inertia acceleration torque added to the set value b is. This allows to perform a stable acceleration operation even if a state change (material change, paper width change, radius change, or acceleration change) occurs in the roll paper.

In this embodiment, the torque set value up to the time D is set to b, thereby generating the load torque c corresponding to the LF roller acceleration and the roll paper inertia. The load torque c may be adjusted by setting a torque set value other than b.

(3) Deceleration Region of LF Roller

At the time of deceleration, a roll inertia deceleration torque is necessary for decelerating the roll paper. With only the set value b that is the same as in the steady section, a load corresponding to the roll inertia is generated, and excessive slack occurs (see FIG. 6B). When the torque Troll corresponding to the roll paper inertia deceleration torque is added to the set value b, the deceleration operation of the roll paper can coordinate with the operation of the LF roller so as to suppress the excessive slack. (The acceleration at the time of deceleration exhibits a negative value, and the roll paper inertia deceleration torque also exhibits the CW value). This force is set in the CW direction in which the load to the LF roller becomes large, and changes the value of the torque Troll to the CW side with respect to the set value b. Since the operation is performed basically in the slack state, the generated load torque remains in the load torque b having a value "0", as shown in FIG. 7D.

FIG. 7C shows a case (CASE 3) in which a large roll paper inertia deceleration torque $T_{LID}$ is applied and a case (CASE 4) in which a small roll paper inertia deceleration torque $T_{SID}$ is applied, as in the acceleration region. The larger the inertia of the operation target is, the larger the roll paper inertia deceleration torque added to the set value b is. This allows to perform a stable deceleration operation even if a state change (material change, paper width change, radius change, or acceleration change) occurs in the roll paper.

Figure 8:
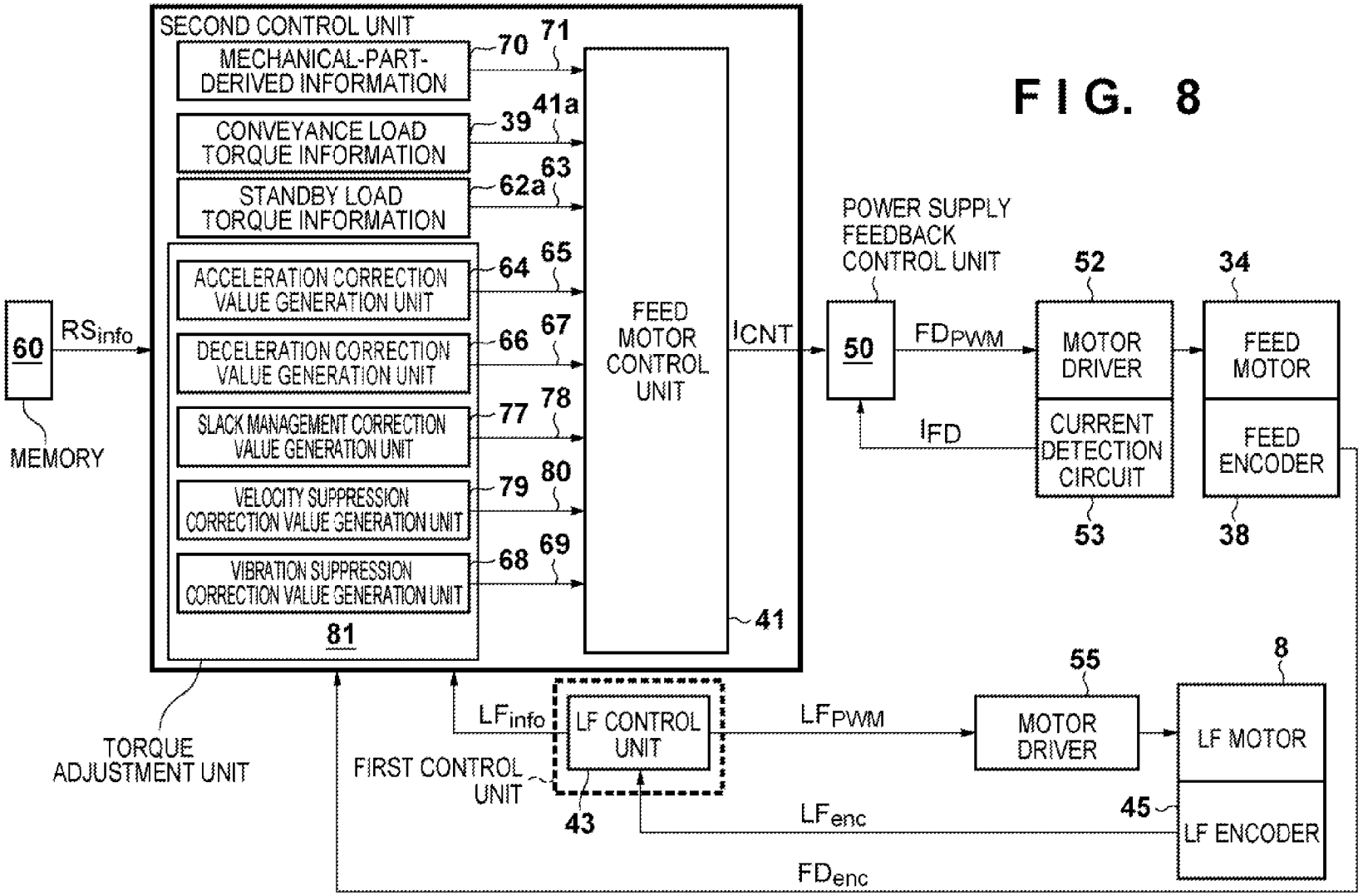
FIG. 8 is a block diagram showing the control arrangement of the feed mechanism of the printing apparatus shown in FIG. 1.

FIG. 8 is a block diagram showing the control arrangement of the feed mechanism of the printing apparatus shown in FIG. 1. The control block includes a first control unit (thick broken line in FIG. 8) that controls driving of the LF roller, and a second control unit (thick solid line in FIG. 8) that controls driving of the feed motor.

The first control unit receives LF encoder information $LF_{enc}$ and outputs LF operation information $LF_{info}$ and a PWM value $LF_{PWM}$ that is the operation amount to a motor driver 55. The PWM value $LF_{PWM}$ is determined by performing control calculation of the difference between LF operation target and the LF encoder information $LF_{enc}$ detected from an LF encoder 45 connected to the LF roller 9. The LF encoder is provided at the periphery of the conveyance roller and also called a conveyance encoder. The LF encoder is used to estimate the position, velocity, and the acceleration of the conveyance roller. The PWM value $LF_{PWM}$ is input to the motor driver 55 to do drive control of an LF motor 8. The LF motor 8 serves as a driving source to drive the LF roller 9. An LF control unit 43 serves as a feedback control unit which outputs the series of operation information $LF_{info}$ including the position, velocity, acceleration, and state information of the LF roller to the second control unit as the control information from the first control unit.

The second control unit receives roll paper state information $RS_{info}$ stored in a memory 60, the LF operation information $LF_{info}$ from the first control unit, and feed encoder information $FD_{enc}$.

The second control unit determines, from the roll paper control information, the roll paper state information, and the LF operation information, mechanical-part-derived information 70, conveyance load torque information 39, standby load torque information 62*a*, and output values of an torque adjustment unit 81. Note that the roll paper control information includes the position, velocity, and acceleration estimated from the feed encoder information $FD_{enc}$.

The mechanical-part-derived information 70 includes control information (static mechanical load correction value) for guaranteeing static mechanical characteristics and control information (dynamic mechanical load correction value) for guaranteeing dynamic mechanical characteristics. In the following explanation, the static mechanical load correction value and the dynamic mechanical load correction value will be referred to as a mechanical load reference value 71 altogether. The mechanical load reference value 71 is a minimum torque necessary for rotating the roll paper.

The output value of the conveyance load torque information 39 is a conveyance load torque set value 41*a*. The output value of the standby load torque information 62*a* is a standby load torque 63. These output values are determined based on the roll paper state information $RS_{info}$ such as the material, paper width, and radius of the roll paper R as the conveyance target.

The torque adjustment unit 81 includes an acceleration correction value generation unit 64, a deceleration correction value generation unit 66, a vibration suppression correction value generation unit 68, a slack management correction value generation unit 77, and a velocity suppression correction value generation unit 79. The acceleration correction value generation unit 64 outputs an acceleration inertia correction value 65. The deceleration correction value generation unit 66 outputs a deceleration inertia correction value 67. These output values are determined based on the roll paper state information $RS_{info}$ and the LF operation information $LF_{info}$, and correspond to a necessary torque according to the inertia component of the roll paper. The values may be multiplied by correction coefficients according to the situation.

The vibration suppression correction value generation unit 68 outputs a vibration suppression correction value 69. The vibration suppression correction value generation unit 68 calculates a compensation value corresponding to the viscosity term using the roll paper control information and the LF operation information $LF_{info}$. This allows to obtain the vibration suppression correction value 69 serving as a torque adjustment value that makes the roll paper smoothly follow the operation target velocity while suppressing it from excessively vibrating.

The slack management correction value generation unit 77 outputs a slack management correction value 78. The slack management correction value generation unit 77 obtains the slack management correction value 78 serving as a torque adjustment value to set the slack amount of the roll paper to an appropriate value using the roll paper control information and the LF operation information $LF_{info}$.

The velocity suppression correction value generation unit 79 outputs a velocity suppression correction value 80. The velocity suppression correction value generation unit 79 obtains the velocity suppression correction value 80 serving as a torque adjustment value to implement an appropriate operation velocity using the roll paper control information.

These output values are input to a feed motor control unit 41. The control section is determined by determining the state based on the LF operation information $LF_{info}$, and an appropriate combination of output values is selected. As a result, a current value corresponding to the necessary torque is determined and output as a current value $I_{cnt}$.

The feed motor 34 as the operation target is driven by a PWM-controlled motor driver 52. The motor driver 52 does not guarantee the current value to be supplied to the motor. For this reason, a current detection circuit 53 for confirming the current value to be supplied to the feed motor 34 detects a current value $I_{FD}$. A PWM value $FD_{PWM}$ as the output value is adjusted in accordance with the difference between the current value $I_{cnt}$ and the current value $I_{FD}$. A current feedback control unit 50 is thus formed.

Figures 9A, 9B, 9C, 9D:
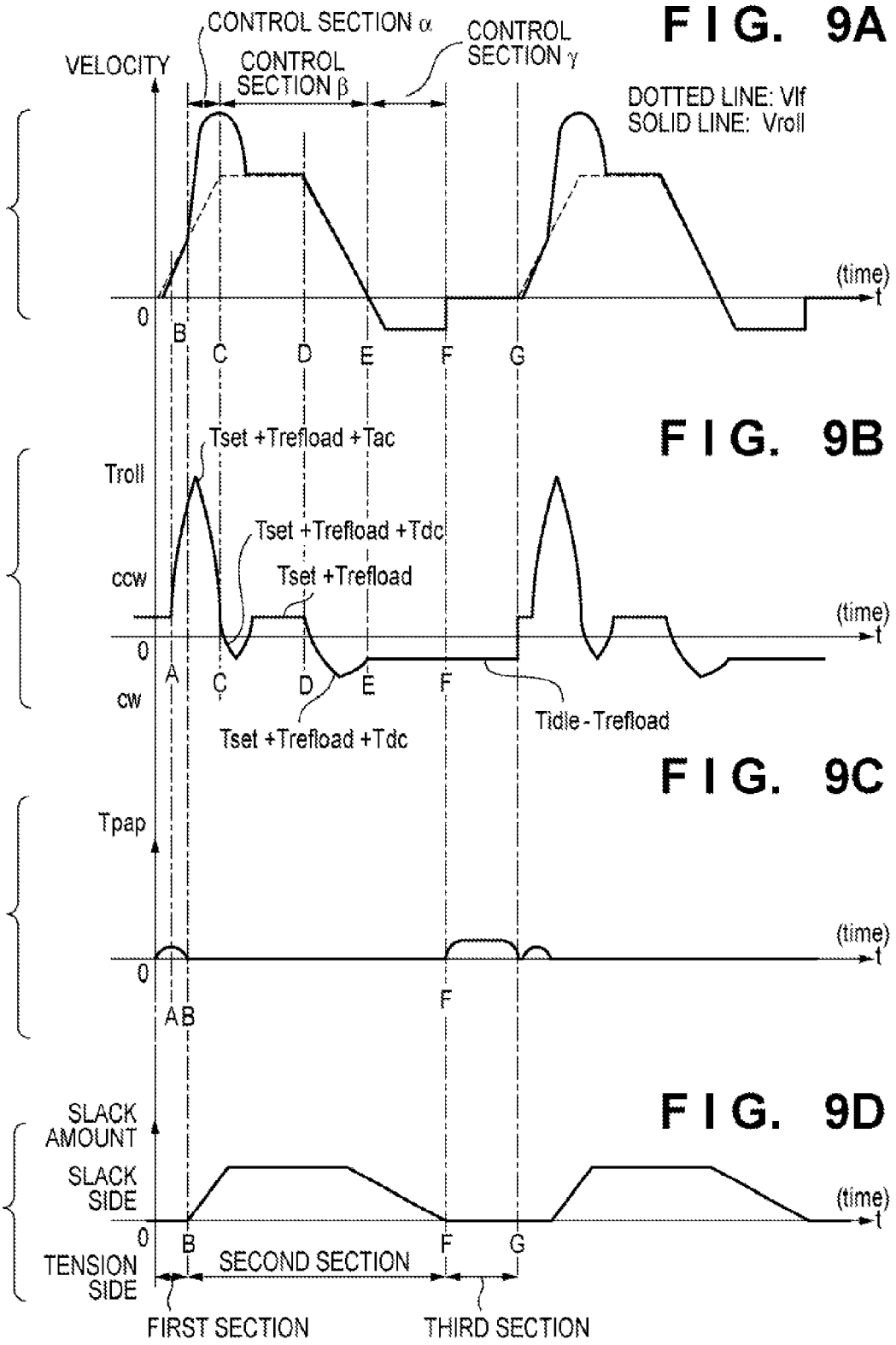
FIGS. 9A, 9B, 9C, and 9D are timing charts for explaining a case in which the conveyance control shown in FIG. 8 is applied to the actual conveyance operation.

FIGS. 9A to 9D are timing charts for explaining a case in which the conveyance control shown in FIG. 8 is applied to the actual conveyance operation. FIG. 9A shows the waveforms of the LF roller velocity Vlf and the roll paper velocity Vroll. FIG. 9B shows the waveform of the torque Troll applied to the feed motor. FIG. 9C shows the waveform of the load Tpap applied to the printing paper between the LF roller and the roll paper. FIG. 9D shows the waveform of the slack of the roll paper. The conveyance velocity Vpap of the printing paper is the same as the LF roller velocity Vlf.

The changes between the feeder load generation section and the feeder load zero section correspond to the first section (time 0-B), the second section (time B-F), and the third section (time F-G) of the roll paper slack waveform shown in FIG. 9D. That is, in the first section, the roll paper is accelerated from the stopped state to generate a load on the feeder. The second section is the feeder load zero section. In the third section, the feed motor is reversely rotated in the direction reverse to the feed direction to generate a load on the feeder. The second section is further divided into a control section α (time B-C), a control section β (time C-E), and a control section γ (time E-F). The divided sections are the control sections shown in the velocity waveforms of FIG. 9A.

The states in the first, second, and third sections will be described here.

In the first section, the LF roller conveys the sheet while bearing the load of the roll paper. As shown in FIG. 9B, the feed motor generates, in the CCW direction, a torque that is in balance with the mechanical load originally existing in the feed driving unit. The load generated on the LF roller side at this time corresponds to the inertia of the roll paper. A larger load can be applied by applying the torque generated by the feed motor in the CW direction. When this load is generated, skewed conveyance of the roll paper is eliminated along the spool shaft. After that, an acceleration torque in the CCW direction is generated for the feed motor so that the roll paper is accelerated to a desired velocity. Control is performed at that time to make the rotation velocity of the roll paper higher than that of the LF roller, thereby causing transition from the first section to the second section.

In the second section, the acceleration torque generated in the first section is continuously applied to accelerate the roll paper to the desired velocity. After that, a deceleration torque is generated to decelerate the roll paper until its velocity matches the LF roller velocity. During the time until the matching to the LF roller velocity, a target roll paper slack is generated. From then on, the velocity of the roll paper is controlled to be the same as that of the LF roller until the LF roller stops. Hence, the target slack amount is maintained. During the steady operation of the LF roller, a torque that is in balance with the mechanical load is generated in the CCW direction. When the LF roller decelerates, a deceleration torque corresponding to the roll paper inertia is generated to quickly decelerate the roll paper, thereby decreasing the roll paper velocity. After the LF roller has stopped, the feed motor is driven in the CW direction to move the roll paper in the wind back direction, thereby gradually eliminating the slack. When the slack is completely eliminated, transition to the third section occurs.

In the third section, a predetermined torque is applied in the CW direction by the feed motor until the start of the next conveyance operation. At this time, the torque is generated within a range where the roll paper on the LF roller side does not move so as not to deteriorate the conveyance accuracy.

Roll paper conveyance control in the first, second, and third sections will be described next.

Conveyance Control in First Section

In the first section, the current value $I_{cnt}$ is calculated by adding a mechanical load reference value $T_{refload}$ determined from the acceleration inertia correction value 65, the vibration suppression correction value 69, the slack management correction value 78, and the mechanical-part-derived information 70 to the conveyance load torque set value ($T_{set}$) 41*a*. Immediately after acceleration of the LF roller, the feeder load generation section (time 0-A) is set. To do this, the acceleration inertia correction value 65 is set to a value "0" so as to generate a torque determined based on the conveyance load torque set value and the mechanical load reference value. The conveyance load torque set value is basically set to a value "0" corresponding to a no-load value. Hence, only the mechanical load reference value serves as the effective torque in fact. As a result, a load corresponding to the product of the LF roller acceleration and the roll paper inertia is generated. Note that a negative value is set as the conveyance load torque set value to adjust the load generation force or ensure the stability. The load generation force is adjusted from adjustment at the time A.

In the first section after the time A, the roll paper needs to accelerate until an appropriate slack is generated for transition to the second section (feeder load zero section) (time A-B). For this purpose, the necessary acceleration (roll paper acceleration inertia torque $T_{ac}$) is obtained from the remaining time (time A-time C) of the acceleration region and the LF operation information $LF_{info}$. The result is reflected on the acceleration inertia correction value 65 and added to the conveyance load torque set value and the mechanical load reference value, thereby controlling the roll paper.

Note that, in addition to the above-described control, the slack management correction value and the vibration suppression correction value are added to the torque value in the control section as needed, thereby increasing the stability of the control performance.

The above-described calculation in the first section allows to cause transition from the feeder load generation section to the feeder load zero section until the end of acceleration of the LF roller. This makes it possible to minimize the conveyance accuracy deterioration while removing the skewed component of the roll paper.

Conveyance Control in Second Section

The second section is subdivided into three control sections, and a description will be made for each control section.

<Control Section α>

In this section, the roll paper acceleration control in the first section is taken over, and the roll paper is accelerated to the maximum velocity to generate a desired slack. The functions used in the control block at this time are the same as in the first section (time A-B).

<Control Section β>

In the control section β, the current value $I_{cnt}$ is calculated by adding a mechanical load reference value determined from the deceleration inertia correction value 67, the vibration suppression correction value 69, the slack management correction value 78, and the mechanical-part-derived information 70 to the conveyance load torque set value 41*a*. The standby load torque 63 is handled as "0".

In this section, the maximum roll paper velocity generated in the control section α is quickly decreased down to the LF roller velocity. After the roll paper velocity has matched the LF roller velocity, control is performed to move the roll paper at a constant velocity until the LF roller stops. This control allows to convey the roll paper while maintaining the slack amount. The deceleration inertia correction value 67 is validated until the roll paper velocity matches the LF roller velocity so that the deceleration operation is quickly executed. That is, the necessary acceleration (roll paper deceleration inertia torque $T_{dc}$) is obtained. The result is reflected on the deceleration inertia correction value 67 and added to the conveyance load torque set value and the mechanical load reference value, thereby controlling the roll paper in the deceleration operation. After that, in the steady region of the LF roller, the deceleration inertia correction value exhibits a value "0" so that a torque corresponding to the sum of the conveyance load torque set value $T_{set}$ and the mechanical load reference value $T_{refload}$ is generated. In the deceleration section from the time D to the time E, the deceleration inertia correction value 67 that is the torque value necessary for deceleration is validated again, thereby controlling to quickly decelerate the roll paper.

Note that, in addition to the above-described control, the slack management correction value and the vibration suppression correction value are added to the torque value in the control section as needed, thereby increasing the stability of the control performance.

<Control Section γ>

In the control section γ, the roll paper is wound back by an amount corresponding to the slack generated before the end of the control section β. The feed motor is rotated in the CW direction. At this time, if the roll paper is pulled by an excessive force, the conveyance accuracy may be deteriorated in the no slack state. To prevent this, the roll paper is pulled by a force equal to or smaller than a torque value $T_{idle}$ set by the standby load torque 63, thereby winding back the roll paper without any adverse effect on the conveyance accuracy.

Since it is necessary to add a value corresponding to the mechanical load reference value in the wind back direction for cancellation at this time, the mechanical load reference value is subtracted. That is, the torque of the feed motor corresponds to a value obtained by subtracting the value corresponding to the mechanical load reference value from the torque value set by the standby load torque 63.

FIGS. 9A and 9C show a state in which the slack of the roll paper during the conveyance operation is eliminated by winding back the roll paper in the control section γ. That is, the waveform of the roll paper velocity also exhibits a negative value to eliminate the slack. Until the time F the slack is eliminated, the velocity waveform exhibits the negative value (FIG. 9A), whereas the torque Tpap exhibits the value "0" (FIG. 9C).

Note that, in addition to the above-described control, the slack management correction value and the vibration suppression correction value are added to the torque value in the control section as needed, thereby increasing the stability of the control performance.

Conveyance Control in Third Section

Control in this section is the same as the control method in the control section γ of the second section. After the time F, the roll paper stops because no slack exists. A force corresponding to the standby load torque 63 is applied as the torque Tpap.

Note that after it is determined that the slack is eliminated in the third section, the torque generated from the feed motor may be zero from the viewpoint of power consumption and the like.

Hence, according to the above-described embodiment, in the conveyance operation repeated by respectively executing control calculations specific to the first section, the control sections α, β, and γ of the second section, and the third section, it is possible to implement conveyance control of the roll paper with a minimum conveyance accuracy error while removing the skewed component.

In the above-described way, in the intermittent conveyance of the roll paper, the torque to be generated by the feed motor is changed in accordance with the conveyance conditions of the LF roller and the load factors that vary depending on the radius, sheet width, and sheet type of the roll paper, thereby switching between the feeder load generation section and the feeder load zero section. This makes it possible to simultaneously correct skewed conveyance of the roll paper and suppress the decrease in the conveyance accuracy.

Since it is possible to stabilize the conveyance accuracy independently of the state of the roll paper, the image quality improves, and the range of printing media usable by the printing apparatus widens. This also contributes to shortening the conveyance time and reducing the conveyance sound.

Figure 10:
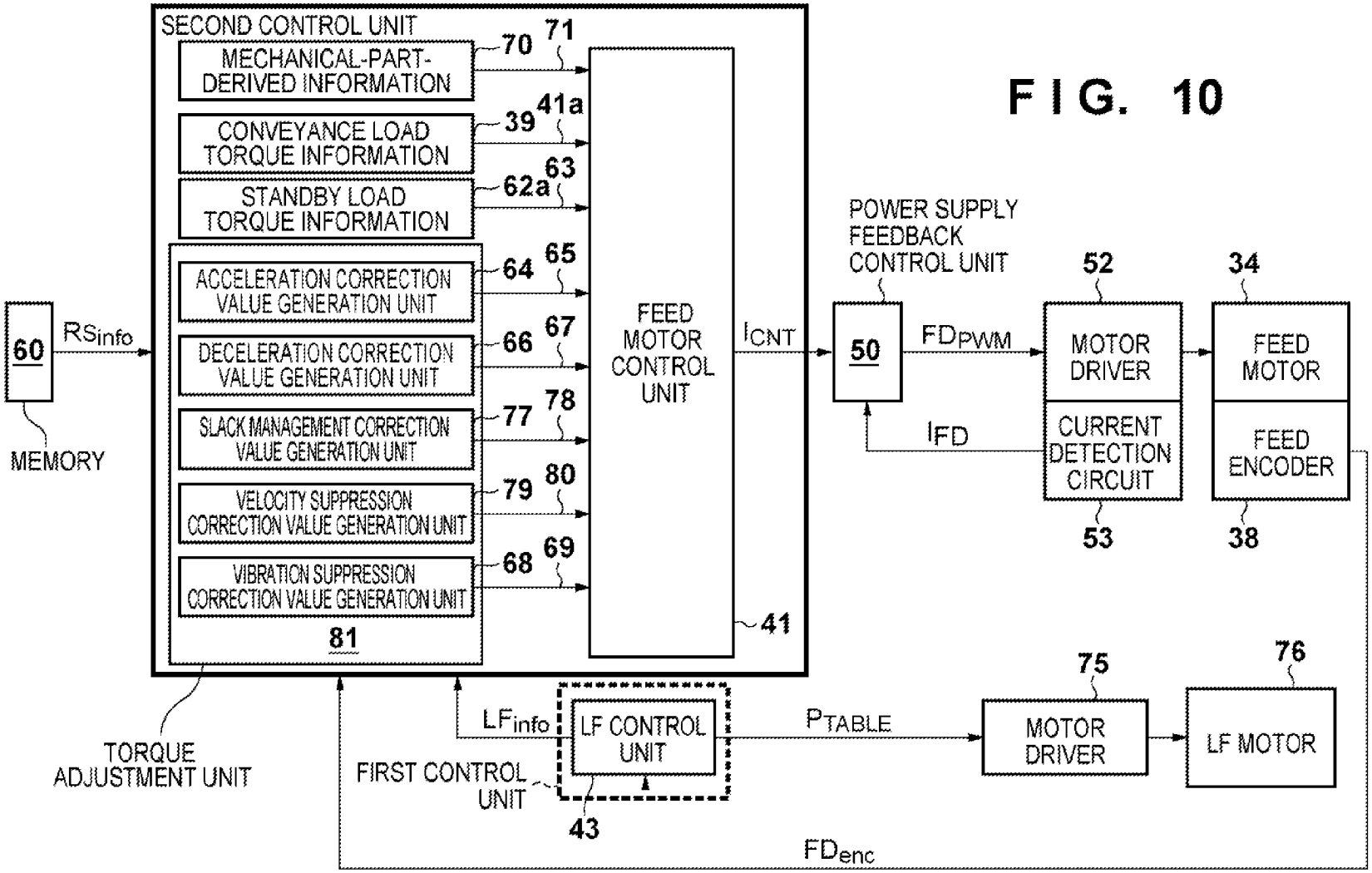
FIG. 10 is a block diagram showing another control arrangement of the feed mechanism of the printing apparatus.

Note that the present invention is not limited to the control arrangement shown in FIG. 8. For example, a control arrangement as shown in FIG. 10 may be employed. The difference of the control arrangement between FIGS. 8 and 10 is the LF roller driving method in the first control unit. Referring to FIG. 10, an LF motor 76 complies with a driving method using, for example, open loop control, like a pulse motor. In this arrangement, a pulse table value $P_{TABLE}$ corresponding to the operation target is output to a motor driver 75, and the LF motor 76 is driven in accordance with the value. The LF control unit 43 outputs the operation target that is the anticipated information of the LF operation as the LF operation information $LF_{info}$.

Second Embodiment

An embodiment will be described in which a back tension to be applied to a pulled out portion P of roll paper is controlled. Note that a description of the same control and constituent elements as those described in the first embodiment will be omitted, and only control unique to this embodiment will be explained.

Figure 11:
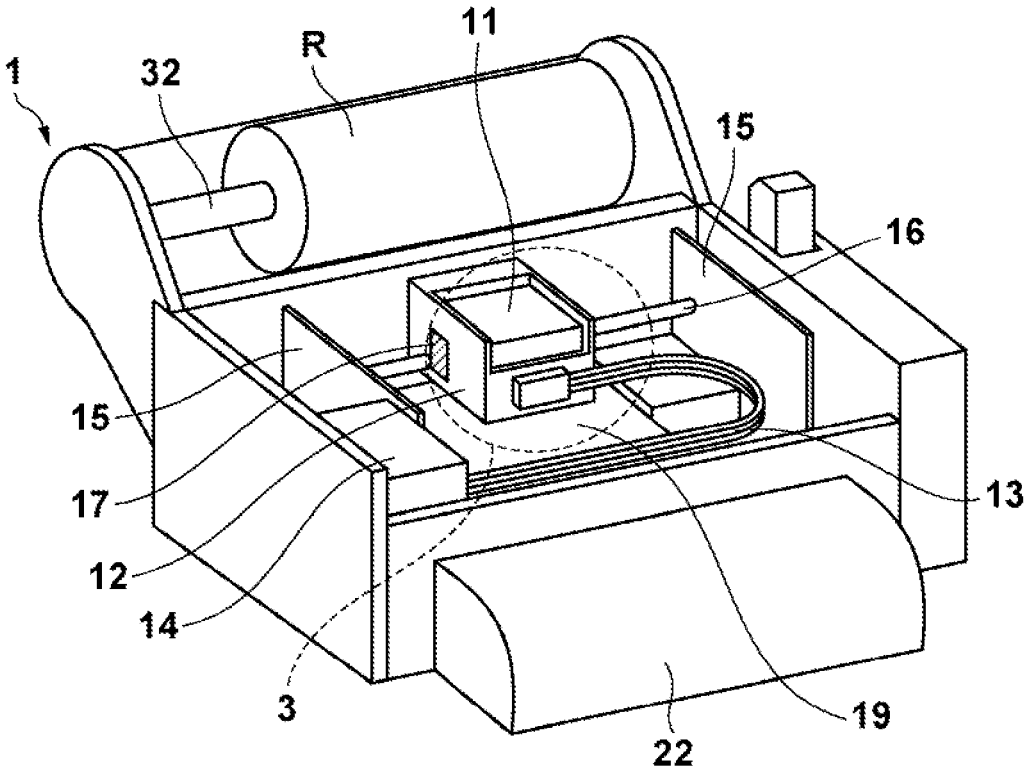
FIG. 11 is a perspective view showing the schematic arrangement of an inkjet printing apparatus including a feed mechanism of roll paper, which performs back tension control.

FIG. 11 is a perspective view showing the schematic arrangement of an inkjet printing apparatus (to be referred to as a printing apparatus hereinafter) including a feed mechanism of roll paper, which performs back tension control.

The arrangement shown in FIG. 11 is the same as that shown in FIG. 1 except a sheet sensor 17 provided on a side surface of a carriage 12. The sheet sensor 17 can detect the presence/absence of a sheet and an edge of a sheet. The sheet sensor 17 can also detect the width of a sheet by reciprocally operating the carriage 12. The sheet sensor 17 can also detect the skewed amount of a sheet by conveying the sheet by a predetermined amount (for example, 300 mm) and detecting a sheet edge position before and after the conveyance.

Figure 12:
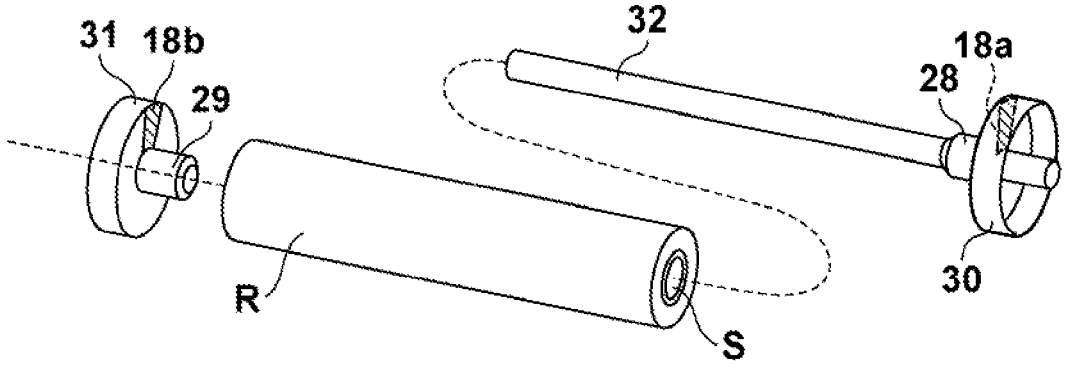
FIG. 12 is a perspective view showing the arrangement of the spool portion of roll paper.

FIG. 12 is a perspective view showing the arrangement of the spool portion of roll paper. In this embodiment, a reference-side roll paper holder 30 includes a plurality of light-emitting units 18*a* arrayed in the radial direction of roll paper R, and a non-reference-side roll paper holder 31 includes light-receiving units 18*b*, as shown in FIG. 12. The light-receiving units 18*b* receive light from the light-emitting units 18*a*, thereby measuring the radius of the roll paper R. The measured radius is used to determine the back tension to be applied to the sheet in conveyance.

<Ideal Conditions of Roll Paper Conveyance>

Figure 13A:
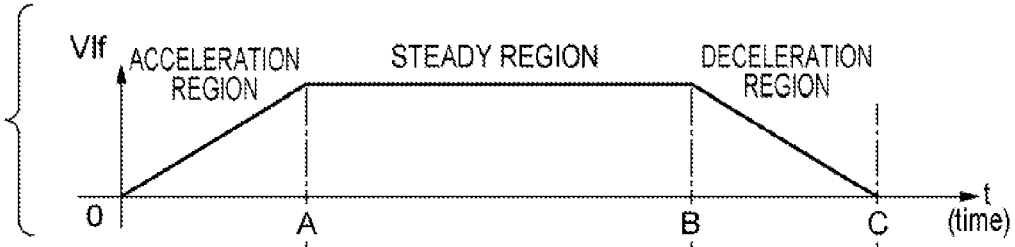
FIGS. 13A, 13B, 13C, and 13D are timing charts for explaining the set value of the torque Troll to implement an ideal state as a target as compared to FIGS. 6A, 6B, 6C, and 6D.
Figure 13B:
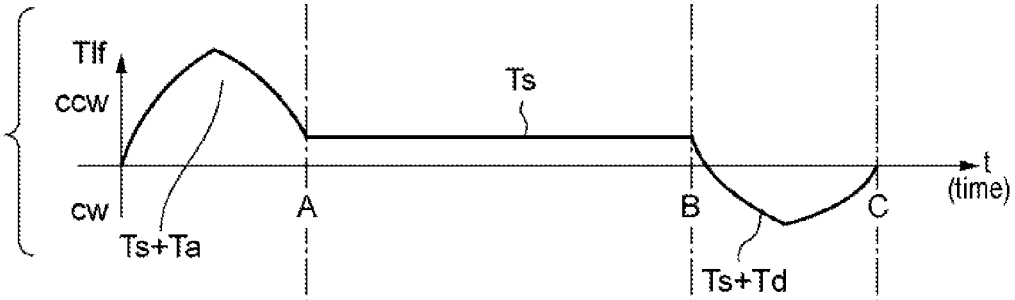

FIGS. 13A to 13D are timing charts for explaining the set value of a torque Troll to implement an ideal state as a target as compared to FIGS. 6A to 6D. The roll paper conveyance operation is the same as that described with reference to FIGS. 6A to 6D, and a description thereof will not be repeated. FIGS. 13A and 13B that illustrate signal waveforms representing time variations of a conveyance roller velocity Vlf and a conveyance roller torque Tlf are the same as FIGS. 6A and 6B.

As an ideal condition, a load having a predetermined value is always continuously applied as a torque Tpap during the operation of the conveyance roller. This aims at uniforming the load independently of the sheet conveyance conditions including the acceleration region, the steady region, and the deceleration region and always obtaining a stable conveyance accuracy. The torque Tpap shown in FIG. 13D reflects this state. Referring to FIG. 13D, the torque Tpap has a predetermined value La through the acceleration region (time 0-A), the steady region (time A-B), and the deceleration region (time B-D).

Another torque (especially Troll) to implement the ideal state will be described.

(1) Steady Region of LF Roller

In the steady region, the influence of the inertia component of the roll paper R does not exist. Hence, a set value a is set as a torque value that corresponds to the torque La representing the load in the CW direction reverse to the direction of the torque Tlf.

(2) Acceleration Region of LF Roller

At the time of acceleration, a roll inertia acceleration torque is necessary for accelerating the roll paper. With only the set value a that is the same as in the steady section, a load corresponding to the inertia of the roll paper is generated (see FIG. 6B). When the torque Troll corresponding to the inertia acceleration torque of the rolled portion is added to the set value a, the load except the set value a is suppressed. This force is set in the CCW direction in which the load to the conveyance roller becomes small, and changes the torque Troll to the CCW side with respect to the set value a. The roll paper inertia acceleration torque is thus consumed by accelerating the roll paper. As a result, only the torque La corresponding to the set value a is applied to the sheet as the torque Tpap.

Figure 13C:
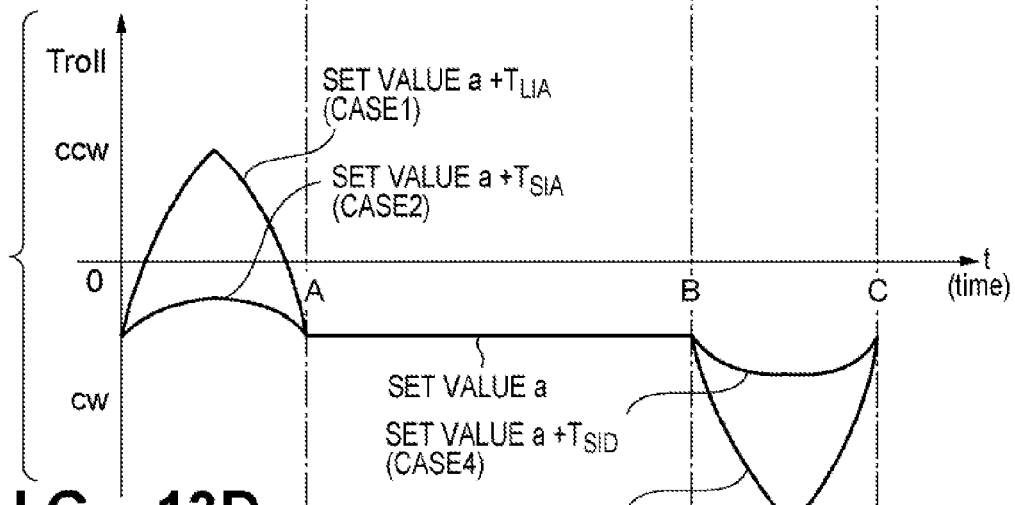
Figure 13D:
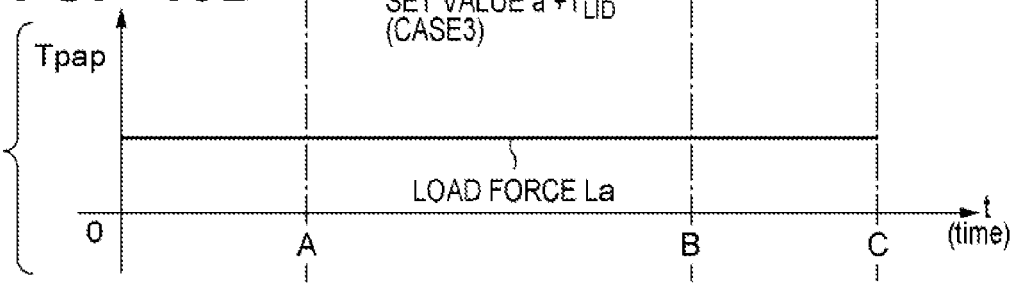

FIG. 13C shows both a case (CASE 1) in which a large roll paper inertia acceleration torque $T_{LIA}$ is applied and a case (CASE 2) in which a small roll paper inertia acceleration torque $T_{SIA}$ is applied. The larger the inertia of the operation target is, the larger the roll paper inertia acceleration torque added to the set value a is. This allows to perform a stable acceleration operation even if a state change (material change, paper width change, radius change, or acceleration change) occurs in the roll paper.

(3) Deceleration Region of LF Roller

At the time of deceleration, a roll inertia deceleration torque is necessary for decelerating the roll paper. With only the set value a that is the same as in the steady section, a load corresponding to the inertia of the rolled portion is generated (see FIG. 6B). When the torque Troll corresponding to the inertia deceleration torque of the rolled portion is added to the set value a, the load except the set value a can be suppressed. (The acceleration at the time of deceleration exhibits a negative value, and the roll paper inertia deceleration torque also exhibits the CW value). This force is set in the CW direction in which the load to the conveyance roller becomes large, and changes the value of the torque Troll to the CW side with respect to the set value a. The decrease in the load torque caused by the influence of the roll inertia can be canceled by causing the torque Troll to increase the load. Hence, the load La that is a predetermined load is applied even in the deceleration region.

FIG. 13C shows both a case (CASE 3) in which a large roll paper inertia deceleration torque $T_{LID}$ is applied and a case (CASE 4) in which a small roll paper inertia deceleration torque $T_{SID}$ is applied, as in the acceleration region. The larger the inertia of the operation target is, the larger the roll paper inertia deceleration torque added to the set value a is. This allows to perform a stable deceleration operation even if a state change (material change, paper width change, radius change, or acceleration change) occurs in the roll paper.

<Example of Arrangement of Back Tension Control>

Figure 14:
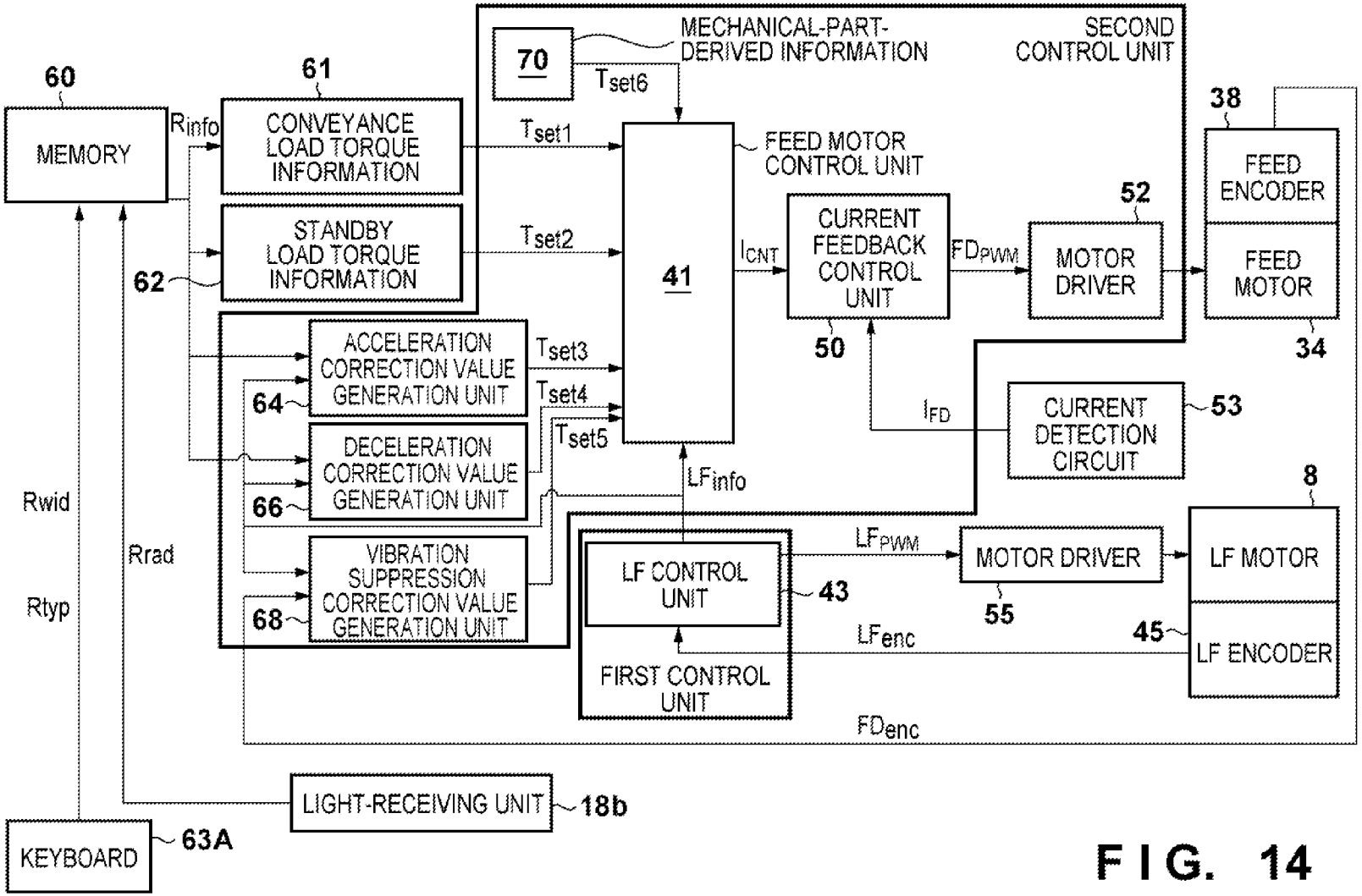
FIG. 14 is a block diagram showing a control arrangement according to the second embodiment in the feed mechanism of the printing apparatus shown in FIG. 11.

FIG. 14 is a block diagram showing a control arrangement according to one embodiment in the feed mechanism of the printing apparatus shown in FIG. 11. The control block includes a first control unit that controls driving of the LF roller in the above-described acceleration region, steady region, and deceleration region, and a second control unit that controls driving of the feed motor so as to apply a back tension to the pulled out portion P and make the conveyance velocity Vlf of the LF roller equal to the conveyance velocity Vroll of the roll paper. Note that referring to FIG. 14, the same reference numerals as in FIG. 8 denote the same constituent elements already described there, and a description thereof will be omitted.

<First Control Unit>

The first control unit outputs a series of LF operation information $LF_{info}$ including the driving start timing, velocity, acceleration, and state information of the LF roller to the second control unit as control information from the first control unit by its feedback function.

<Second Control Unit>

The second control unit receives a conveyance load torque set value $T_{set1}$, a standby load torque $T_{set2}$, the conveyance operation information $LF_{info}$, roll paper information $R_{info}$, a detected current value $I_{FD}$, and feed encoder information $FD_{enc}$. The second control unit outputs a PWM value $FD_{PWM}$ that is the operation amount to the motor driver based on the above-described inputs. The roll paper information $R_{info}$ stored in a memory 60 is setting information to be used to determine the torque Tpap serving as a back tension and will be described below in detail.

The light-receiving unit 18*b* detects the radius of the rolled portion and stores a detected radius $R_{rad}$ in the memory 60. The printing apparatus includes a keyboard 63A through which the user inputs a sheet width (the width in a direction perpendicular to the sheet conveyance direction) and a paper type (the type of sheet). An input sheet width $R_{wid}$ and sheet type $R_{typ}$ are stored in the memory 60. The memory 60 outputs the stored information as the roll paper information $R_{info}$.

In this embodiment, tables 61 and 62 store the correspondence between the radius $R_{rad}$, the sheet width $R_{wid}$, and the sheet type $R_{typ}$ and the conveyance load torque set value $T_{set1}$, and the correspondence between those and the standby load torque $T_{set2}$, respectively. The corresponding conveyance load torque set value $T_{set1}$ and standby load torque $T_{set2}$ are output from the tables 61 and 62 to the second control unit. The driving torque of the feed motor in the steady region is represented by $Troll=T_{set1}-T_{set6}$, as will be described later. Hence, the driving torque of the feed motor is adjusted by looking up the tables 61 and 62. Note that the roll paper information and the set values have the relationship shown in FIG. 17 (to be described later).

A feed motor control unit 41 selectively uses an acceleration correction torque $T_{set3}$, a deceleration correction torque $T_{set4}$, a vibration suppression torque $T_{set5}$, and the mechanical load reference torque $T_{set6}$ using the conveyance load torque set value $T_{set1}$ and the standby load torque $T_{set2}$ as reference values.

An acceleration correction value generation unit 64 outputs the acceleration correction torque $T_{set3}$ as the torque value in the CCW direction necessary for accelerating the rotation of the rolled portion. A deceleration correction value generation unit 66 outputs the deceleration correction torque $T_{set4}$ as the torque value in the CCW direction when decelerating the rotation of the rolled portion. A vibration suppression correction value generation unit 68 outputs the vibration suppression torque $T_{set5}$ as the torque value in the CCW direction. The mechanical load reference torque $T_{set6}$ that has simply been mentioned as the mechanical-part-derived information in the above-described embodiment is the torque value in the CCW direction.

Note that the correction value generation units 64, 66, and 68 calculate the respective torque values by receiving the feed encoder information $FD_{enc}$ output from a feed encoder 38 provided in a feed motor 34 and the conveyance operation information $LF_{info}$ output from an LF control unit 43. More specifically, the feed encoder information $FD_{enc}$ includes the moving distance of the sheet from the start of conveyance to the current time, the current rotation velocity, and the roll paper diameter. The conveyance operation information $LF_{info}$ includes an estimated acceleration to be applied to the conveyance roller. To synchronize the roll paper side with the conveyance roller side, the acceleration to be applied to the roll paper is determined based on these pieces of information, the moment of inertia of the roll paper is calculated from its diameter, and the driving force of the feed motor is determined from the acceleration and the moment of inertia.

As described above, in this embodiment, the series of processing units including the feed motor control unit 41 and a current feedback control unit 50 constitutes the second control unit.

<Conveyance Control Method>

Figures 15A, 15B, 15C:
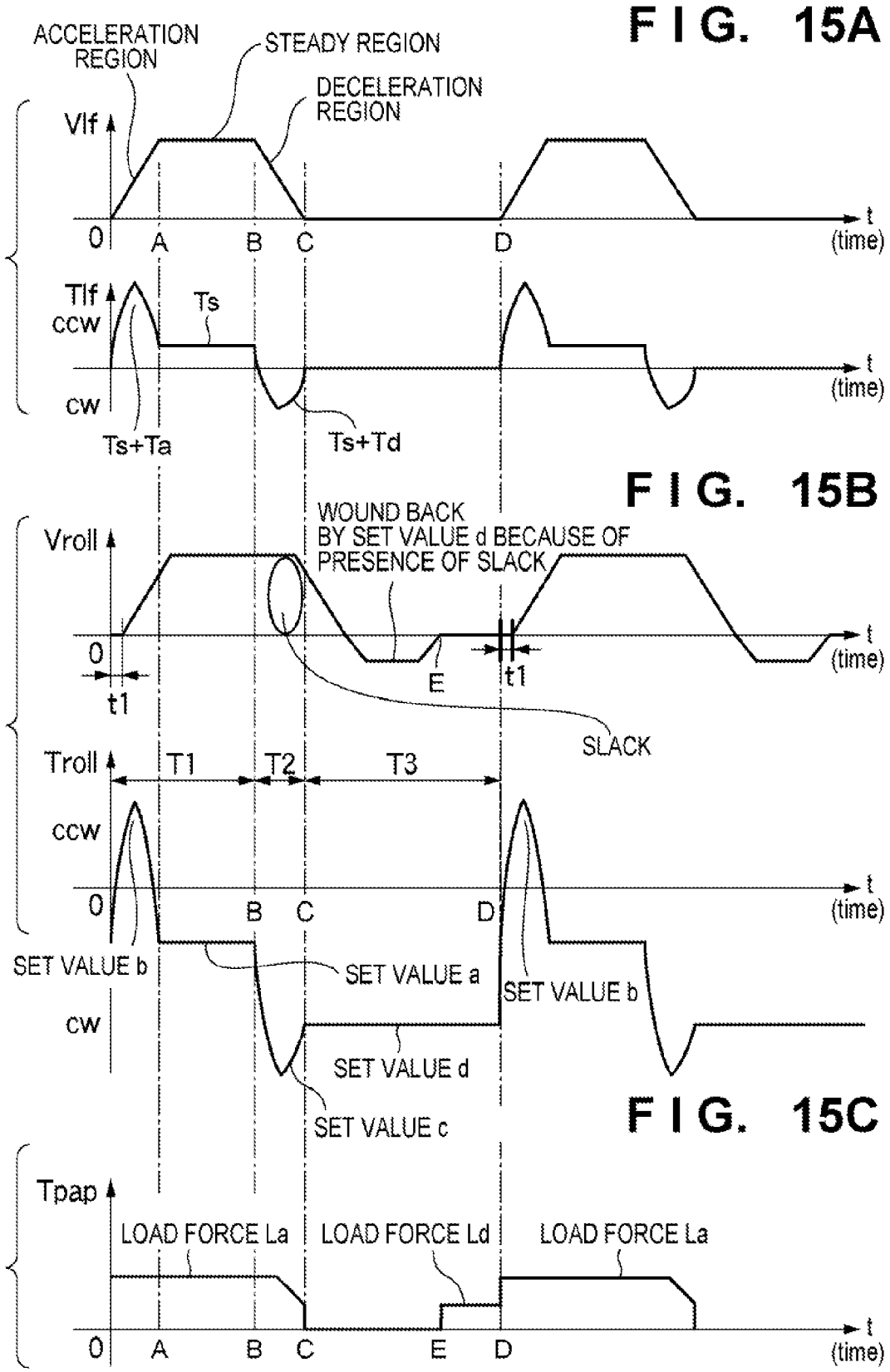
FIGS. 15A, 15B, and 15C are timing charts for explaining an example in which the conveyance control is applied to the actual conveyance operation so as to apply a predetermined back tension to a sheet through the acceleration section, the steady section, and the deceleration section.

FIGS. 15A to 15C are timing charts for explaining one example in which the conveyance control by the first and second control units shown in FIG. 14 is applied to the actual conveyance operation so as to apply a predetermined back tension to a sheet through the acceleration section, the steady section, and the deceleration section. FIG. 15A shows the time variations of the velocity Vlf and the torque Tlf of the conveyance roller. FIG. 15B shows the time variations of the velocity Vroll and the torque Troll of the rolled portion. FIG. 15C shows the time variation of the torque Tpap serving as a load applied to the pulled out portion P. The conveyance velocity Vpap of the sheet is equal to the velocity Vlf of the conveyance roller.

In the actual conveyance operation, a slack phenomenon in the pulled out portion P and/or the mechanical load of the conveyance mechanism as the operation target exists. Taking them into consideration, the ideal torque Tpap is attained by calculating the value of the torque Troll using the control arrangement shown in FIG. 14. The value of the torque Troll used in the following explanation corresponds to a current value $I_{CNT}$ in FIG. 14.

In this embodiment, using the operation information of the velocity Vlf of the conveyance roller, conveyance control is performed by dividing the time period as follows. That is, the time from the start of movement of the conveyance roller to the start of deceleration is defined as a first period T1 (time 0-B), the time from the start of deceleration of the conveyance roller to the stop as a second period T2 (time B-C), and the time from the stop of the conveyance roller to the next operation as a third period T3 (time C-D).

In the first period T1, the acceleration correction torque $T_{set3}$ output from the acceleration correction value generation unit 64 and the vibration suppression torque $T_{set5}$ output from the vibration suppression correction value generation unit 68 are added to the conveyance load torque set value $T_{set1}$, and the mechanical load reference torque $T_{set6}$ is subtracted. The standby load torque $T_{set2}$ is handled as 0.

The acceleration correction value generation unit 64 adds an acceleration correction coefficient to a value obtained from the conveyance roller acceleration and the roll paper information $R_{info}$, thereby obtaining the acceleration correction torque $T_{set3}$ corresponding to the roll paper acceleration inertia. The vibration suppression correction value generation unit 68 adds a viscosity compensation coefficient to a value obtained from the feed encoder information $FD_{enc}$ and the conveyance operation information $LF_{info}$, thereby obtaining the vibration suppression torque $T_{set5}$ that acts to suppress the vibration of the feeder. The mechanical load reference torque $T_{set6}$ is a load that originally exists in the driving system itself. Hence, the mechanical load reference torque $T_{set6}$ is subtracted from the conveyance load torque set value that is the load to be generated on the roll paper, and the remainder is generated as a load by the feed motor.

In the steady region (A-B), the feed motor is driven by the predetermined torque Troll {(set value a)=$T_{set1}-T_{set6}$} in the conveyance direction. At this time, the load La is given to the torque Tpap. In the steady region (A-B), since the acceleration of the conveyance roller is also 0 (zero), calculations need not be performed in consideration of the acceleration/deceleration. FIG. 15B indicates that when the conveyance load torque set value $T_{set1}$ has a negative value larger than the mechanical load reference torque $T_{set6}$, the set value a is set in the CW direction. However, if the original mechanical load is about 3 kgf, and the motor is driven by a load of 1.5 kgf, the set value a may be set on the CCW side. Finally, the torque is converted into a current value corresponding to the torque Troll as an instruction value to the motor. This value is determined from the specifications of the motor or the transmission mechanism.

In the acceleration region (0-A), the acceleration correction torque $T_{set3}$ is added to the set value a to obtain a set value b so as to compensate for roll paper acceleration inertia. In the acceleration section (0-A), since the acceleration of the conveyance roller is not 0, the acceleration correction torque $T_{set3}$ is not 0, either.

As a result, the load variation upon acceleration is canceled. In the first period T1 (0-B), the torque Tpap represents the load La having a predetermined value, and the back tension stabilizes. The relationship with the driving torque Tlf of the conveyance roller will be examined here. The torque Tlf conveys the roll paper in the conveyance direction (CCW direction) in which the velocity Vlf of the conveyance roller exhibits a positive value, including all mechanical loads on the conveyance driving system. For this reason, the torque necessary at least in the steady section (A-B) without acceleration/deceleration is always set in the CCW direction. On the other hand, the torque Troll is set in the CW direction because it is necessary to apply a predetermined load to the conveyance roller in the steady section (A-B). That is, a relationship given by Tlf>Troll is held in the steady region (A-B). Based on this relationship, a necessary inertia is added to each of the torques Tlf and Troll in the acceleration/deceleration region.

Even if the torque Tpap is constant, the velocity Vlf of the conveyance roller does not necessarily match the velocity Vroll of the roll paper because of, for example, the influence of the path between the conveyance roller and the roll paper. For example, as shown in FIG. 15B, a delay $t_1$ may occur on the roll paper side concerning the timing of driving the conveyance roller and the roll paper.

In the second period T2, the deceleration correction torque $T_{set4}$ output from the deceleration correction value generation unit 66 and the vibration suppression torque $T_{set5}$ output from the vibration suppression correction value generation unit 68 are added to the conveyance load torque set value $T_{set1}$, and the mechanical load reference torque $T_{set6}$ is subtracted. The standby load torque $T_{set2}$ is handled as 0.

The deceleration correction value generation unit 66 adds a deceleration correction coefficient to a value obtained from the acceleration of the conveyance roller at the time of deceleration and the roll paper information $R_{info}$, thereby obtaining the deceleration correction torque $T_{set4}$ corresponding to the roll paper deceleration inertia.

Since the second period T2 corresponds to the deceleration section, the deceleration correction torque $T_{set4}$ is added to the set value a so that the torque Troll obtains a set value c changed to the CW side to compensate for the roll paper acceleration inertia.

As a result, the load variation upon deceleration is canceled. In the second period T2 (B-C), the torque Tpap represents the load La having a predetermined value, and the back tension stabilizes. However, the velocity Vlf of the conveyance roller does not necessarily match the velocity Vroll of the roll paper, as described above, and a slight sheet slack may occur. In the case shown in FIG. 15B, slight slack occurs due to the delay $t_1$ in driving the roll paper. In this case, there is a period where the torque Tpap is smaller than La.

In the third period T3, the mechanical load reference torque $T_{set6}$ is added to the standby load torque $T_{set2}$. The conveyance load torque set value $T_{set1}$ is handled as 0.

The mechanical load reference torque $T_{set6}$ is a load that originally exists in the driving system itself. Hence, to autonomously move the roll paper, the mechanical load reference torque $T_{set6}$ needs to be added to the standby load torque $T_{set2}$. In this case, the set value of the torque Troll changes to a set value d.

In the third period T3, the roll paper rotates in the CW (wind back) direction by the amount of the slack that has occurred after the stop of the conveyance roller. In the example shown in FIG. 15B, the small amount of slack during the operation is eliminated by winding back the paper in the third period T3. In this example, the velocity Vroll of the roll paper is also set in the CW direction to eliminate the slack. At the time E, the slack is eliminated. After that, the torque Tpap applies the small load Ld to the roll paper.

As a result, even when slack occurs during conveyance, the conveyance can be started at the next operation start (time D) under the same conditions as those of the first conveyance roller operation (time t=0). In this embodiment, after the elapse of the time obtained in advance as a time sufficient for eliminating the paper slack, the torque Troll of the feed motor in the third period T3 is set to turn off its output from the viewpoint of safety for heat generation of the motor and reduction of the power consumption.

As described above, performing the control shown in FIGS. 15A to 15C enables to repeat the conveyance operation always with a stable paper slip amount and stabilize the printing quality. The above-described control is performed when the printing apparatus prints using the feed motor as a load generator for the conveyance roller. In addition, when the printing apparatus executes a sequence of winding back the roll paper, the feed motor is driven and controlled as a mere driving force generator. This arrangement is formed in consideration of reduction of the components of the roll paper driving unit.

Figure 16A:
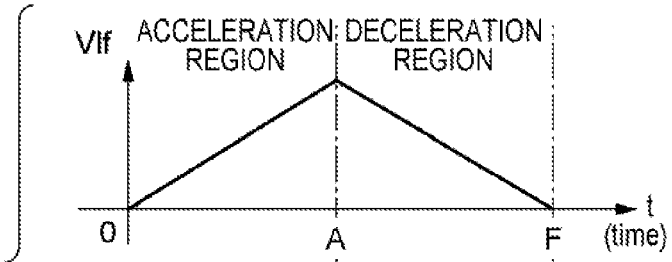
FIGS. 16A, 16B, and 16C are timing charts for explaining the set value of the torque Troll to implement ideal roll paper conveyance when the velocity Vlf of the conveyance roller includes only the acceleration section and the deceleration section.
Figure 16B:
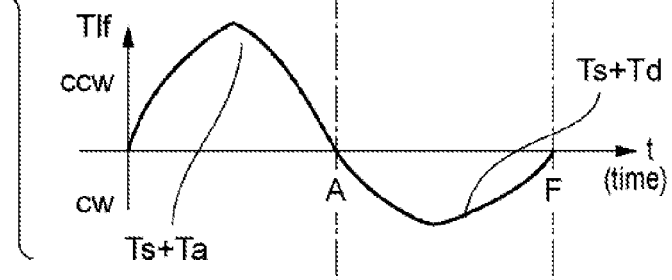
Figure 16C:
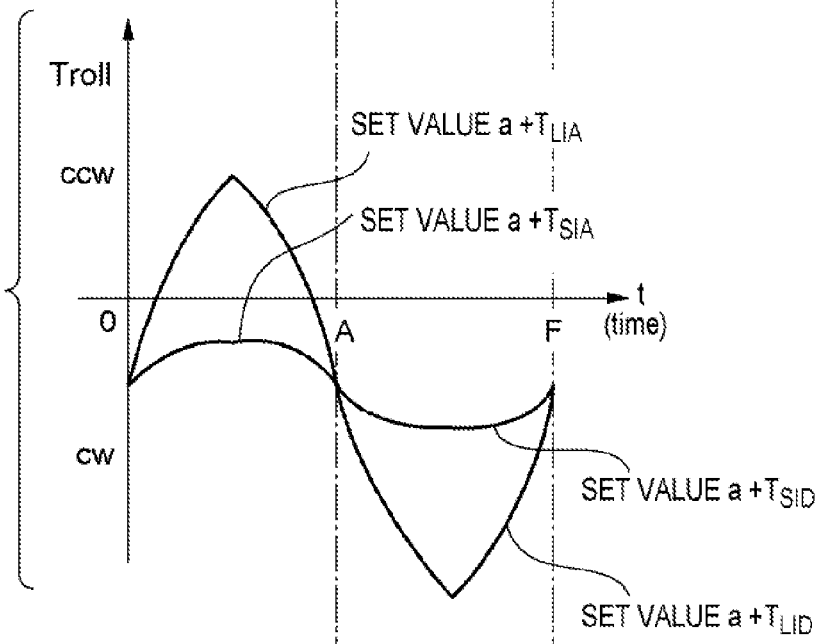
Figure 16C:
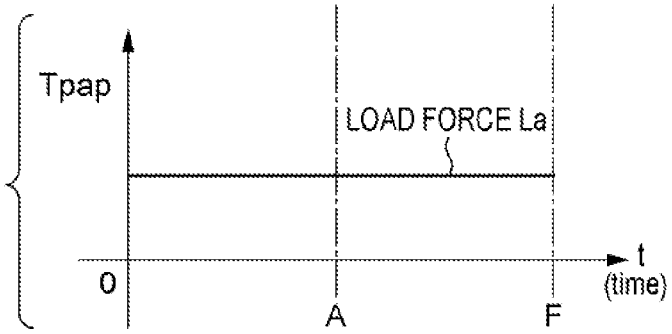

FIGS. 16A to 16C are timing charts for explaining the set value of the torque Troll to implement ideal roll paper conveyance when the velocity Vlf of the conveyance roller includes only the acceleration region and the deceleration region. The roll paper condition (inertia) is the same as in the example shown in FIGS. 13A to 13D.

In this arrangement, since the steady region does not exist, the set value of the torque Troll of the roll paper is obtained by adding a corresponding roll paper inertia to the set value a (not shown) in each of the acceleration region and the deceleration region. In addition, since the roll paper inertia cancels the variation in the load on the roll paper, the torque Tpap always gives the load La, as shown in FIG. 16C.

Referring to FIGS. 16A to 16C, the time t=A is the deceleration start time. For this reason, the section of time 0-A corresponds to the first period T1 in FIG. 15B, and the section of time A-F corresponds to the second period T2 in FIG. 15B. Hence, when the same control calculations as those described with reference to FIGS. 15A to 15C are performed in the section of time 0-A and the section of time A-F, the torque Tpap serving as the load La can be obtained.

Figure 17:
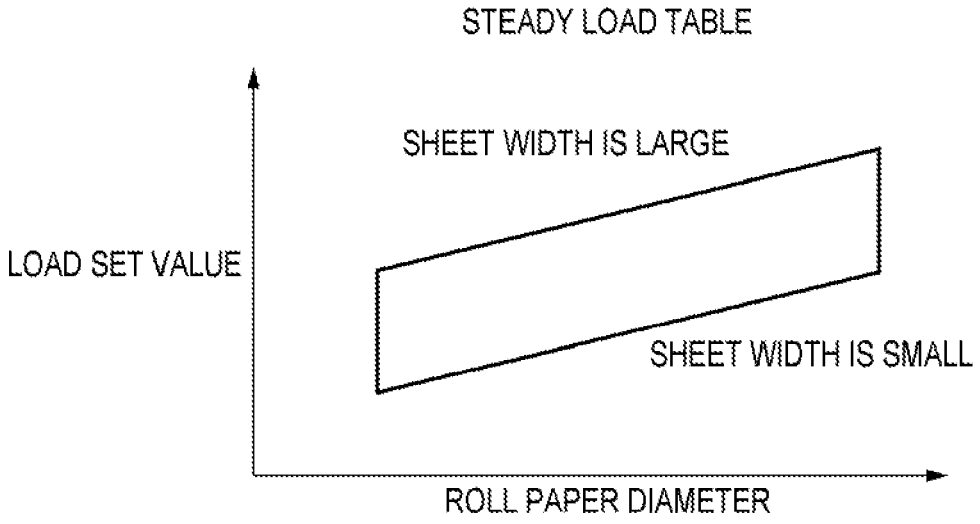
FIG. 17 is a graph schematically showing the relationship between the roll paper and the values set in tables 61 and 62.

FIG. 17 is a graph schematically showing the relationship between the roll paper and the values set in the tables 61 and 62. Referring to FIG. 17, the abscissa represents the diameter of the roll paper R, and the ordinate represents the load set to the torque Tpap. According to FIG. 17, the larger the diameter of the roll paper is, the larger the set load is. The conveyance force generated by the pair of conveyance rollers 9 and 10 increases in proportion to the sheet width. For this reason, the larger the sheet width is, the larger the set value corresponding to the diameter of the roll paper is. Accordingly, optimum points are selected within the parallelogram shown in FIG. 17 in accordance with the sheet conditions of the printing apparatus and used as the load set values corresponding to the minimum and maximum sheet widths available as printing paper sheets. If the sheet type changes, the parallelogram also changes.

When the region of the parallelogram is enormous, it may be necessary to set a large load. In this case, since the steady current value supplied to the motor is too large, the motor driving circuit may generate heat or the power consumption may undesirably be large. In such a case, the back tension variation caused by the paper width may be adjusted as a conveyance correction value so as to simply execute load setting corresponding to the diameter of the roll paper.

Furthermore, under the condition that the inertia of the roll paper R is the same, the conveyance load torque set value $T_{set1}$ and the standby load torque set value $T_{set2}$ have a relationship given by $T_{set1}>T_{set2}$.

Figure 18A:
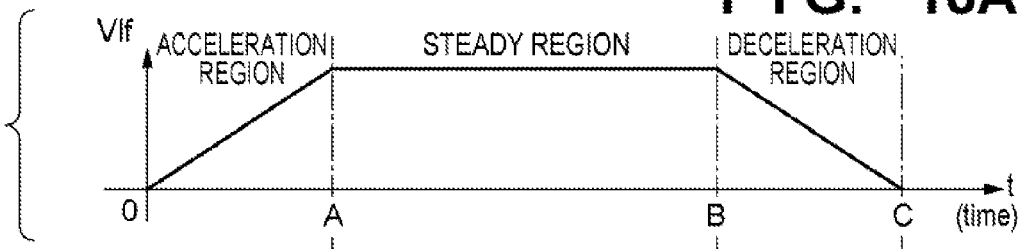
FIGS. 18A, 18B, 18C, and 18D are timing charts for explaining the set value of the torque Troll when the roll paper condition (inertia) remains unchanged, and a conveyance load torque set value $T_{set1}$ becomes larger as compared to the condition shown in FIGS. 13A to 13D.
Figure 18B:
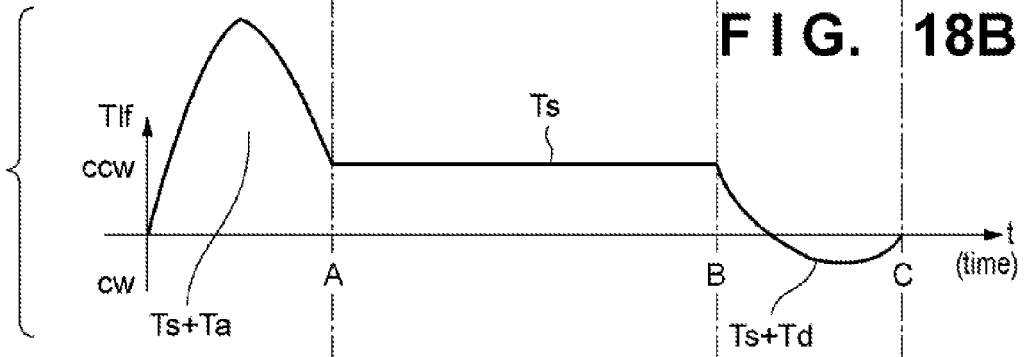
Figure 18C:
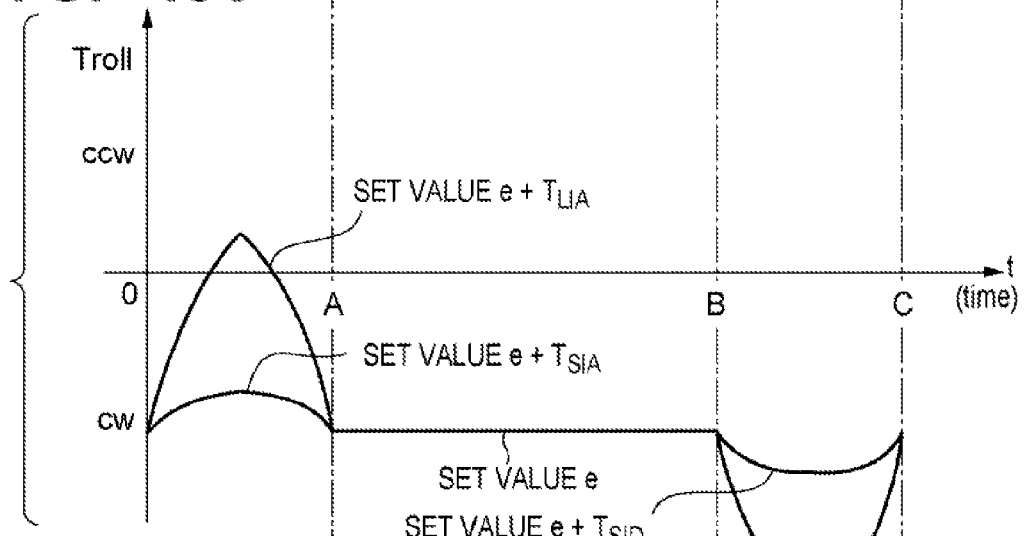
Figure 18D:
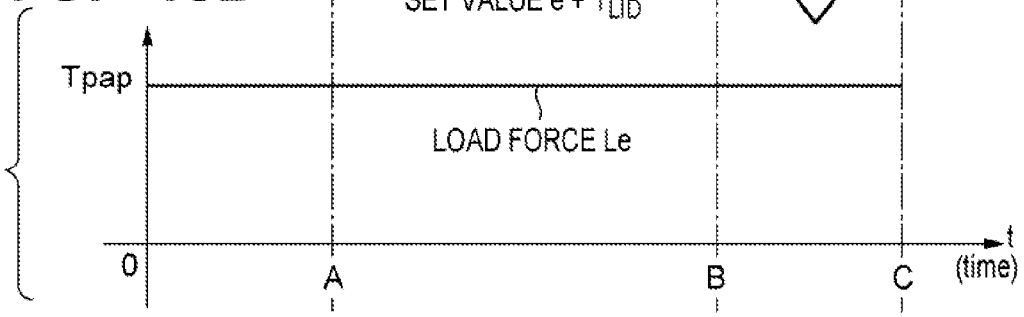

FIGS. 18A to 18D are timing charts for explaining the set value of the torque Troll when the roll paper condition (inertia) remains unchanged, and the conveyance load torque set value $T_{set1}$ becomes larger as compared to the condition shown in FIGS. 13A to 13D. To apply a larger load Le to the sheet, a larger set value e is given to the CW side as the torque Troll, as shown in FIG. 18C. When the reference value shifts to the CW side, the entire torque Troll shifts to the CW side.

Referring to FIGS. 18A to 18D, the time t=B is the deceleration start time. For this reason, the section of time 0-B corresponds to the first period T1 in FIG. 15B, and the section of time B-C corresponds to the second period T2 in FIG. 15B. Hence, when the same control calculations as those described with reference to FIGS. 15A to 15C are performed in the section of time 0-B and the section of time B-C, the torque Tpap serving as the load force Le can be obtained.

As described above, according to the second embodiment, the driving torque of the feed motor is controlled in synchronism with the operation of the conveyance roller in the acceleration region, the steady region, and the deceleration region, thereby controlling the torque Tpap serving as a back tension to the printing paper sheet. Thus, controlling the driving torque of the feed motor enables to control the load that the conveyance roller receives from the sheet constant even at the time of acceleration/deceleration. Hence, the roll paper conveyance accuracy can improve.

In addition, since the load is adjustable, a stable conveyance accuracy can be obtained independently of the size and type of sheets or even for sheets other than a paper sheet.

Third Embodiment

Figure 19:
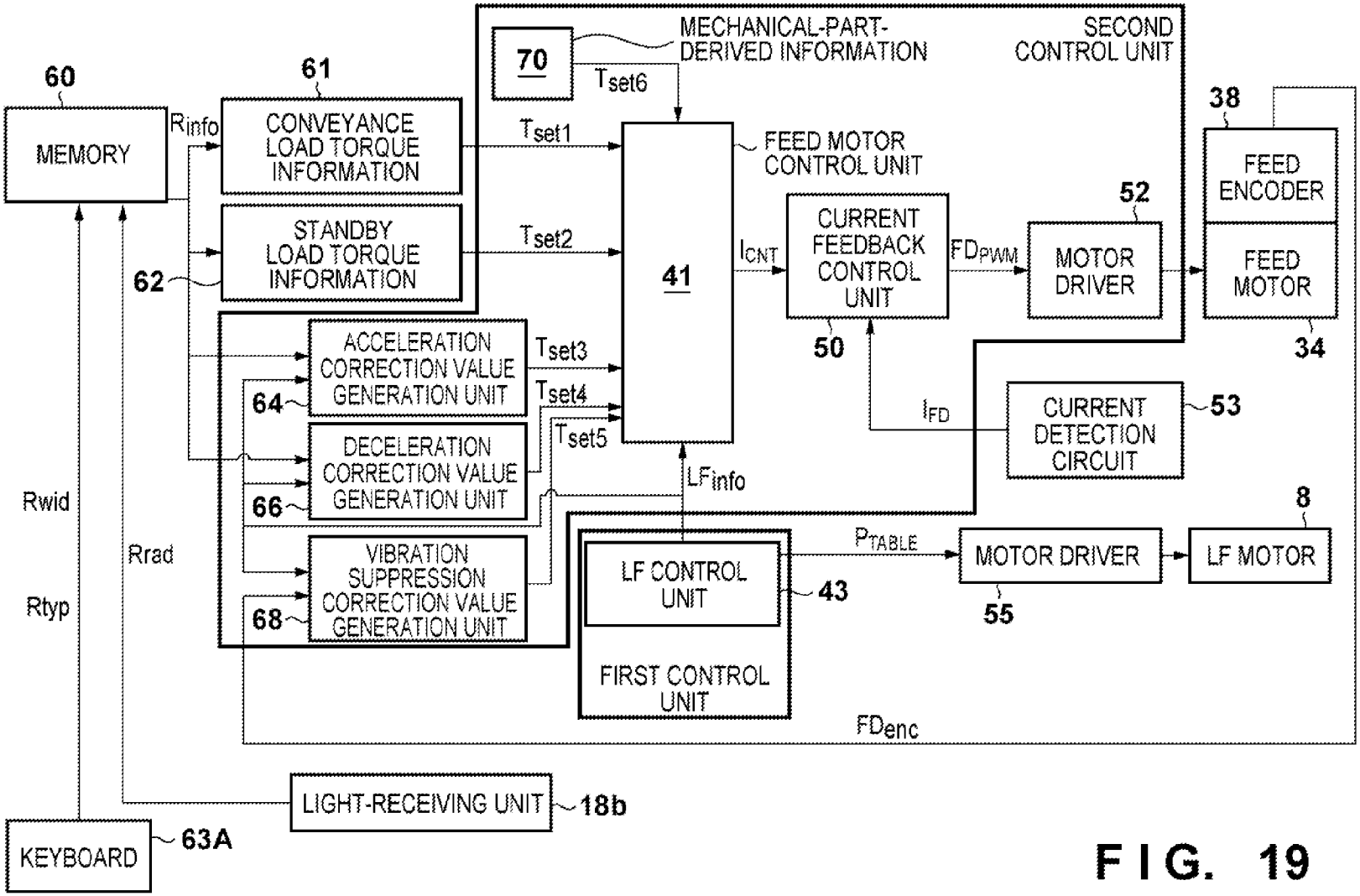
FIG. 19 is a block diagram showing a control arrangement according to the third embodiment in the feed mechanism of the printing apparatus shown in FIG. 11.

FIG. 19 is a block diagram showing a control arrangement according to still another embodiment in the feed mechanism of the printing apparatus shown in FIG. 11. Note that referring to FIG. 19, the same reference numerals as in FIG. 8 or 14 denote the same constituent elements already described there, and a description thereof will be omitted. FIG. 19 is different from FIG. 14 in the conveyance motor driving method in the first control unit. In this embodiment, a conveyance motor 8 is driven by open loop control, like a pulse motor or a stepping motor. In such an arrangement, the first control unit determines the target value of the current to drive the conveyance motor and outputs a pulse table value $P_{TABLE}$ corresponding to the target value to a motor driver 55. The conveyance motor 8 is driven in accordance with the pulse table value $P_{TABLE}$ that is, by the current having the target value determined by the first control unit. An LF control unit 43 outputs the target value of the current that is the expected information of the conveyance operation to the second control unit as conveyance operation information $LF_{info}$ so that a current value $I_{CNT}$ to be supplied to a feed motor 34 is adjusted based on the target value of the current.

As for the driving arrangement of the feed motor, the driving torque of the feed motor is controlled to control the load that the conveyance roller (conveyance motor) receives from the sheet, as in the first and second embodiments. This arrangement is suitable to introduction of open loop control on the conveyance motor side, as in the third embodiment. Additionally, introduction of the open loop control enables to reduce failures resulted from the simplified system and implement an inexpensive printing apparatus.

Fourth Embodiment

Figure 20:
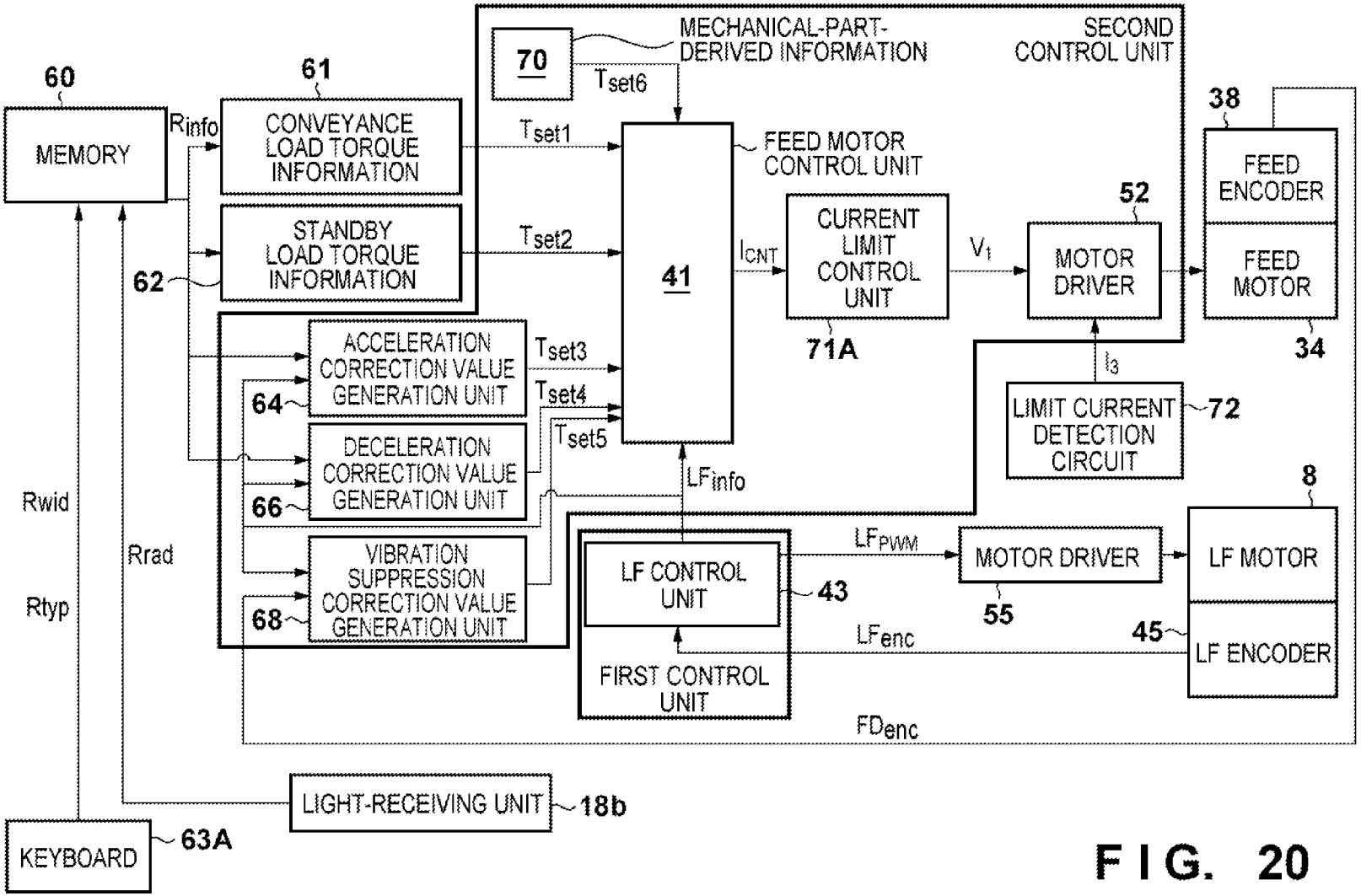
FIG. 20 is a block diagram showing a control arrangement according to the fourth embodiment in the feed mechanism of the printing apparatus shown in FIG. 11.

FIG. 20 is a block diagram showing a control arrangement according to still another embodiment in the feed mechanism of the printing apparatus shown in FIG. 11. Note that referring to FIG. 20, the same reference numerals as in FIG. 8 or 14 denote the same constituent elements already described there, and a description thereof will be omitted. FIG. 20 is different from FIG. 14 in that the second control unit includes a current limit control unit 71A that limits the current value to a feed motor 34. An output current value $I_{CNT}$ from a feed motor control unit 41 is input to the current limit control unit 71A and converted into a voltage value $V_1$ to operate the maximum current value of a motor driver 52. The voltage value $V_1$ is converted into an analog value via a D/A conversion circuit (not shown) and input to the motor driver 52. In the motor driver 52, the current value $I_{CNT}$ is controlled to the maximum current value suppliable to the feed motor 34 based on a current value $I_3$ detected by a limit current detection circuit 72. Note that the limit current value may be controlled by, for example, a pulse signal using serial communication for the current operation amount depending on the specifications on the motor driver.

When, for example, conveying large roll paper, this arrangement can prevent a large current from being supplied to the feed motor at the time of acceleration so as to break the motor down.

Fifth Embodiment

Figure 21:
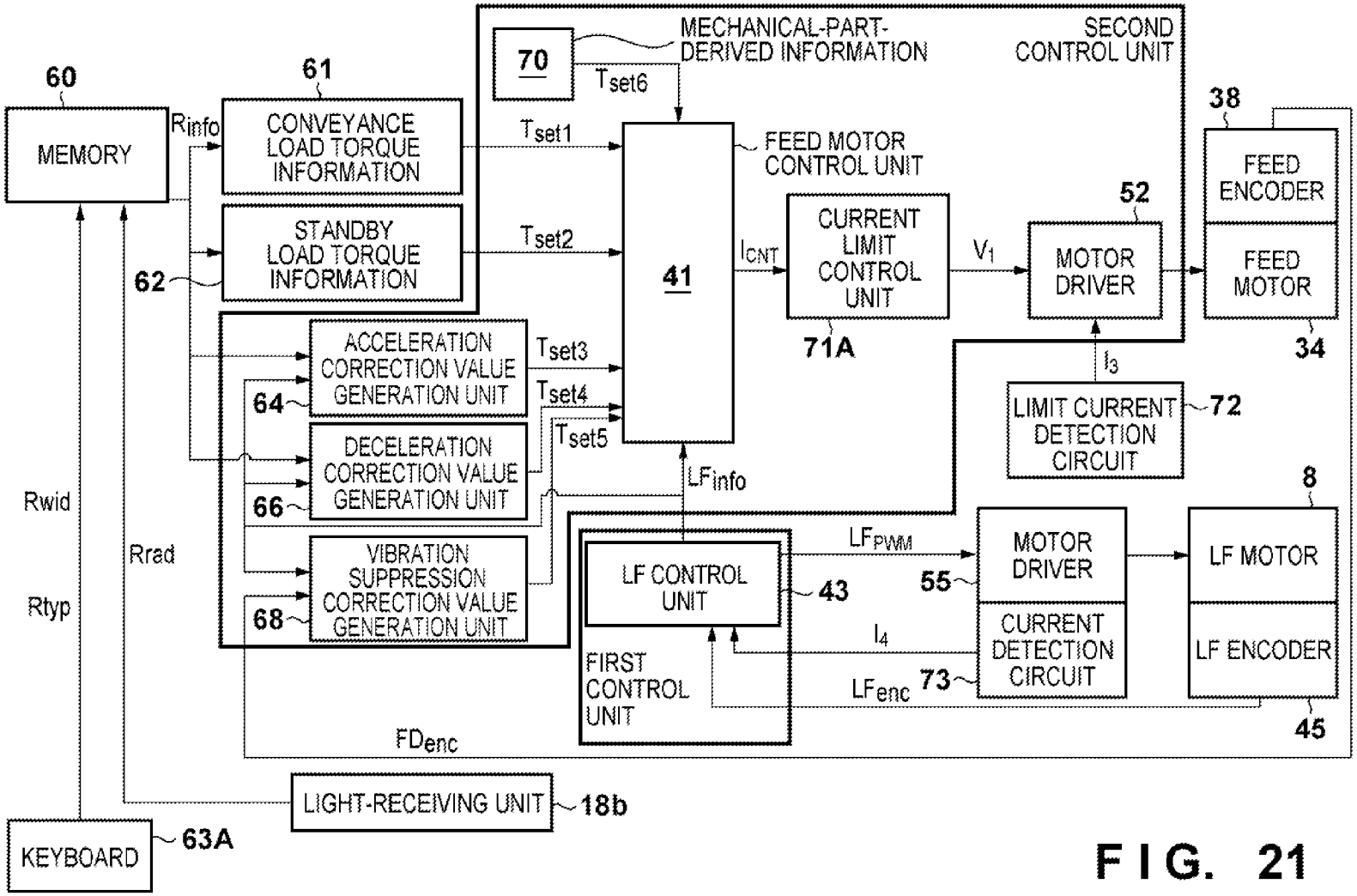
FIG. 21 is a block diagram showing a control arrangement according to the fifth embodiment in the feed mechanism of the printing apparatus shown in FIG. 11.

FIG. 21 is a block diagram showing a control arrangement according to still another embodiment in the feed mechanism of the printing apparatus shown in FIG. 11. Note that referring to FIG. 21, the same reference numerals as in FIG. 8 or 14 denote the same constituent elements already described there, and a description thereof will be omitted. The arrangement of this embodiment further includes a measurement circuit for measuring the load torque applied to the conveyance roller in addition to the arrangement of the fourth embodiment shown in FIG. 20. FIG. 21 is different from FIG. 20 in that a current value $I_4$ measured by an added current detection circuit 73 is output to the first control unit and input to an LF control unit 43. According to this embodiment, since the current detection circuit 73 can measure the load torque actually generated in the conveyance driving system, the difference between the ideal state and the actual load can be estimated. The load torque information is included in the conveyance operation information and input to a feed motor control unit 41.

In this arrangement, the feed motor control unit 41 adjusts a current value $I_{CNT}$ so as to apply a uniform load to the conveyance driving system. This allows to further stabilize the conveyance accuracy.

In all the second to fifth embodiments described above, a sheet wound into a roll is pulled out in the conveyance direction, and the sheet that has been pulled out is conveyed while receiving a back tension from the feed roller. A characteristic feature of these embodiments is that, when the conveyance roller conveys the sheet in at least one of the acceleration region and the deceleration region, control is performed to rotate the sheet wound into the roll by a torque different from that used by the feed roller to convey the sheet in the steady region. Since control is performed to apply a back tension suitable to each sheet conveyance state including the acceleration region, the steady region, and the deceleration region, a stable conveyance accuracy can always be obtained.

Note that in the above-described embodiments, the present invention is applied to an inkjet printing apparatus. However, the present invention is not limited to this. The present invention is widely applicable to, for example, an apparatus that performs various kinds of processing (for example, printing, processing, coating, irradiation, reading, and inspection) by pulling out a continuous sheet wound into a roll.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2011-091469, filed Apr. 15, 2011, 2011-160301, filed Jul. 21, 2011 and 2012-040668, filed Feb. 27, 2012, which are hereby incorporated by reference herein in their entirety.

What is claimed is:

1. A conveyance apparatus for pulling out, in a conveyance direction, a sheet wound into a roll around a roll shaft and conveying the pulled out sheet by a conveyance roller, comprising:

a conveyance motor configured to rotate the conveyance roller;

a first control unit configured to control said conveyance motor such that a rotation velocity of the conveyance roller in the conveyance direction increases in an acceleration region of the conveyance roller, becomes constant in a steady region of the conveyance roller, and decreases in a deceleration region of the conveyance roller;

a feed motor configured to rotate, about the roll shaft, a rolled portion that is a portion of the sheet wound into the roll; and a second control unit configured to control driving of said feed motor, wherein a single conveyance in intermittent conveyance of the pulled out sheet includes the acceleration region, the steady region and the deceleration region, and said second control unit is further configured to control said feed motor so as to:

rotate the rolled portion by a predetermined torque, in the conveyance direction in the steady region, rotate the rolled portion by a torque obtained by adding, to the predetermined torque, a torque in the conveyance direction necessary for accelerating rotation of the rolled portion in the acceleration region, rotate the rolled portion by a torque obtained by adding, to the predetermined torque, a torque in the conveyance direction necessary for decelerating rotation of the rolled portion in the deceleration region, and apply a back tension to the sheet between the rolled portion and the conveyance roller in a state where said first control unit does not execute driving of said conveyance motor for conveyance by the conveyance roller after a first conveyance in the intermittent conveyance and before a second conveyance following the first conveyance.

2. The apparatus according to claim 1, further comprising:

an adjustment unit configured to adjust a magnitude of a predetermined torque to be generated in the steady region, based on at least one of a radius of the rolled portion, a width of the sheet in a direction perpendicular to the conveyance direction, and a type of the sheet.

3. The apparatus according to claim 2, wherein said adjustment unit is further configured to adjust the magnitude of the predetermined torque by looking up a table that associates the radius, the width, and the type with a torque value.

4. The apparatus according to claim 2, further comprising:

a detection unit configured to detect the radius of the rolled portion;

an input unit configured to input the width of the sheet and the type of the sheet; and a memory unit configured to store the radius of the rolled portion, the width of the sheet, and the type of the sheet, wherein said detection unit outputs the radius of the rolled portion to said memory unit, said input unit outputs the width of the sheet and the type of the sheet, which are input, to said memory unit, and the radius of the rolled portion, the width of the sheet, and the type of the sheet stored in said memory unit are output to said adjustment unit.

5. A printing apparatus comprising:

a conveyance apparatus according to claim 1; and a printing unit configured to print on a sheet conveyed by the conveyance apparatus.

6. The apparatus according to claim 1, wherein the second control unit divides a conveyance operation, comprised of: by driving said feed motor and said conveyance motor, accelerating the roll paper from a stopped state to a steady state; decelerating the roll paper; and stopping the roll paper, into a plurality of sections and control to change a torque applied by said feed motor to the roll paper in each of the divided sections.

7. The apparatus according to claim 6, wherein the plurality of sections are divided into:

a first section from accelerating the roll paper from the stopped state to ending control of the acceleration;

a second section from ending the first section to decelerating and stopping the roll paper through conveyance at a constant velocity; and a third section from ending the second section to starting the acceleration of the roll paper for a next conveyance operation, and the second section is further divided into:

a control section α where a velocity of the roll paper reaches a maximum velocity;

a control section β from ending the control section α to decreasing the velocity of the roll paper to zero through the constant velocity; and a control section γ from ending the control section β to changing the velocity of the roll paper from zero to zero again through a negative velocity.

8. The apparatus according to claim 7, wherein said second control unit is further configured to control to cause said conveyance motor to accelerate said conveyance roller and cause said feed motor to apply a torque corresponding to an inertia of the roll paper in the first section, control to cause said feed motor to further increase the velocity of the roll paper so as to slack the edge portion of the roll paper in the control section α of the second section, control to apply a torque to said feed motor in a direction reverse to that in the control section α so as to decrease the velocity of the roll paper, and then control driving of said feed motor and said conveyance motor such that the velocity of the roll paper matches a velocity of said conveyance roller in the control section β of the second section, control to apply the torque to said feed motor in the reverse direction so as to wind back the slack of the edge portion of the roll paper in the control section γ of the second section, and control to apply the torque to said feed motor in the reverse direction while maintaining the velocity of the roll paper at zero in the third section.

9. The apparatus according to claim 8, further comprising:

a conveyance encoder provided for feedback control of said conveyance motor and configured to generate information to estimate a position, a velocity, and an acceleration of said conveyance roller; and a feed encoder provided for feedback control of said feed motor and configured to generate information to estimate a position, a velocity, and an acceleration of the roll paper.

10. The apparatus according to claim 9, wherein a torque generated on said feed motor under control of said second control unit is based at least on the position, the velocity, and the acceleration of said conveyance roller generated by said conveyance encoder.

11. The apparatus according to claim 1, wherein said first control unit controls said conveyance motor by open loop control, and said conveyance motor includes a pulse motor.

12. The apparatus according to claim 1, wherein the predetermined torque in the steady region is a torque in a direction opposite to the conveyance direction.

13. The apparatus according to claim 1, wherein a back tension is applied by the first control unit to the sheet between the rolled portion and the conveyance roller and by the second control unit in the acceleration region, the steady region and the deceleration region.

14. The apparatus according to claim 1, wherein the second control unit adjusts a torque to the rolled portion by controlling a current for driving the feed motor.

* * * * *